US005134950A

United States Patent [19]

Berté

[11] Patent Number: 5,134,950

[45] Date of Patent: Aug. 4, 1992

[54] SAILBOAT

[75] Inventor: Frank J. Berté, West Hartford, Conn.

[73] Assignee: Innovative Marine Technology, Inc., West Hartford, Conn.

[21] Appl. No.: 365,611

[22] Filed: Jun. 13, 1989

[51] Int. Cl.[5] ..... B63B 35/00

[52] U.S. Cl. ..... 114/39.1; 114/61; 114/91; 114/102

[58] Field of Search ..... 114/39.1, 61, 102, 102, 114/91

[56] References Cited

U.S. PATENT DOCUMENTS 3,395,664 8/1968 Greenberg ..... 114/39.1
4,326,475 4/1982 Berté ..... 114/61 X

FOREIGN PATENT DOCUMENTS 2620517 11/1977 Fed. Rep. of Germany ..... 114/39.1
2590826 6/1987 France ..... 114/39.1

*Primary Examiner*—Sherman Basinger

[57] ABSTRACT

A sailboat having a tetrahedral frame formed of six beams, three of which form the triangular deck with three hulls disposed at the vertices of the triangular deck extending outward from the plane of the deck. Two masts are formed by two of the three beams extending upward from the deck. The third beam completes the tetrahedral space frame structure and makes the assemblage rigid, and allows for easy folding of the sailboat space frame structure.

6 Claims, 27 Drawing Sheets

FIG. 2D
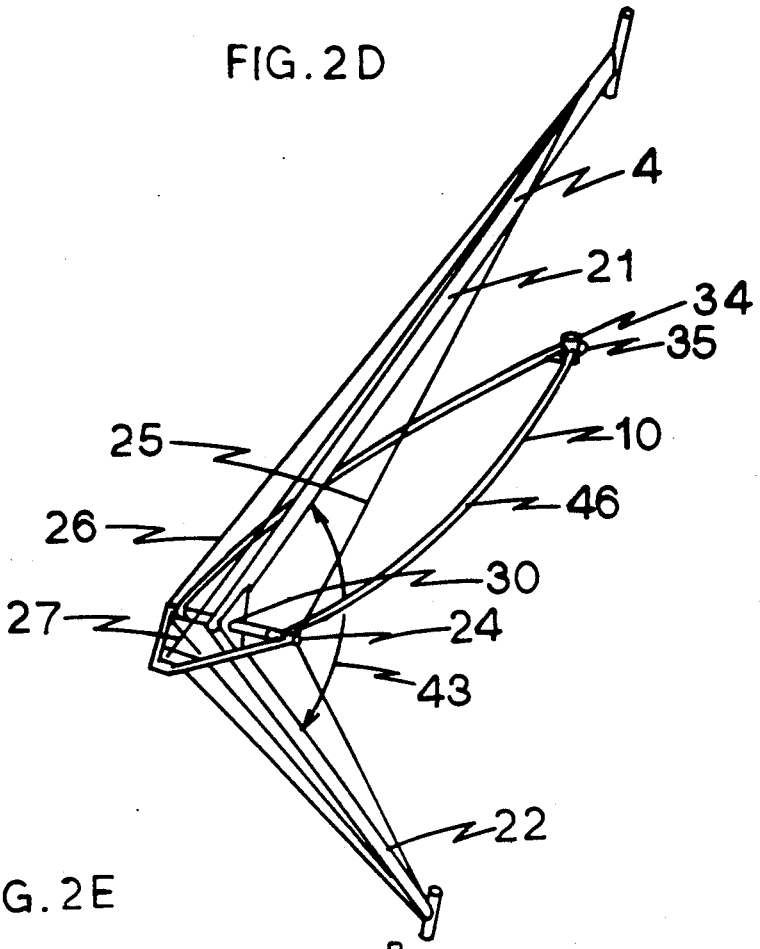
FIG. 2E
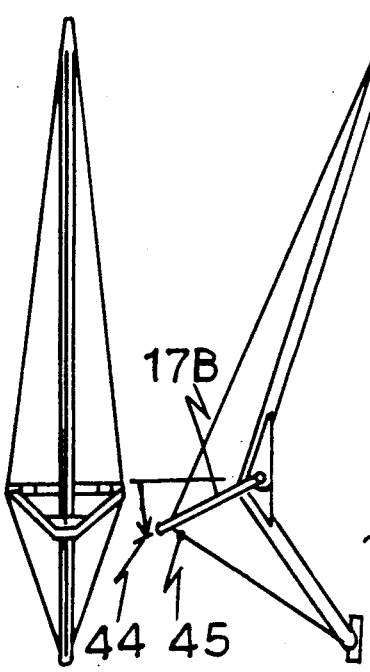
FIG. 2F
FIG. 2G
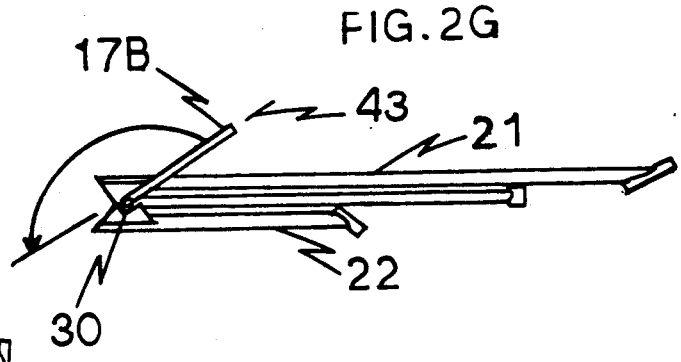

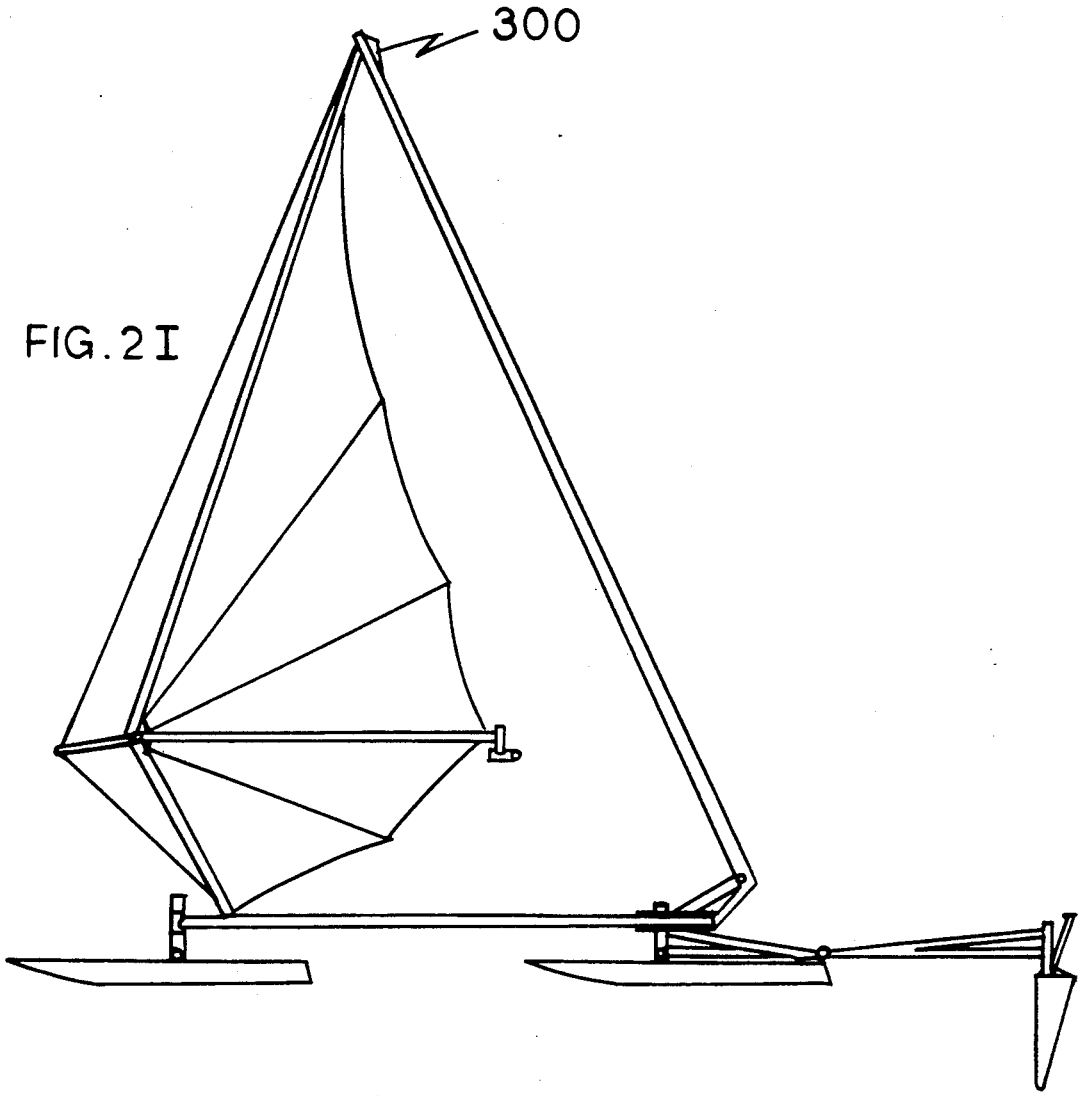
FIG. 2I
FIG. 2J
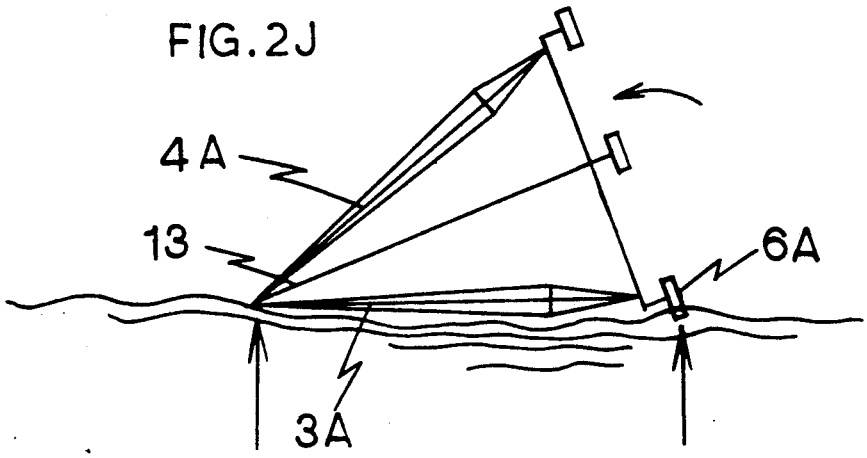

FIG. 9A
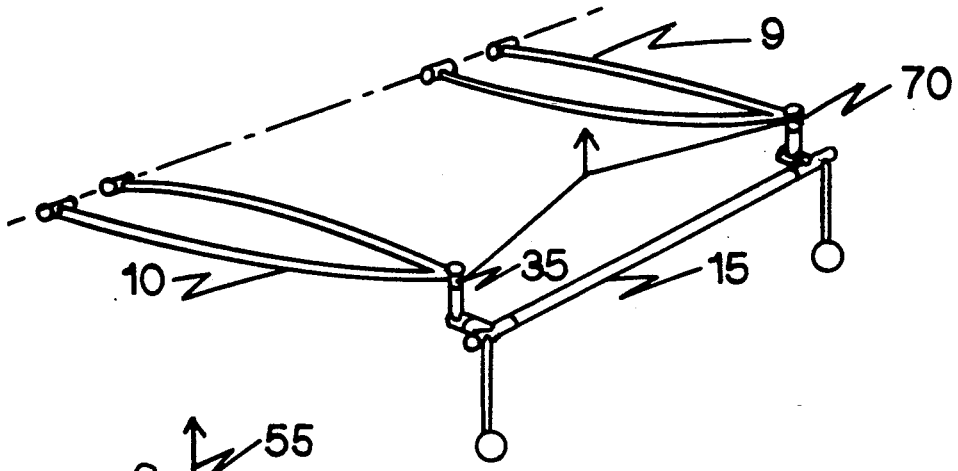
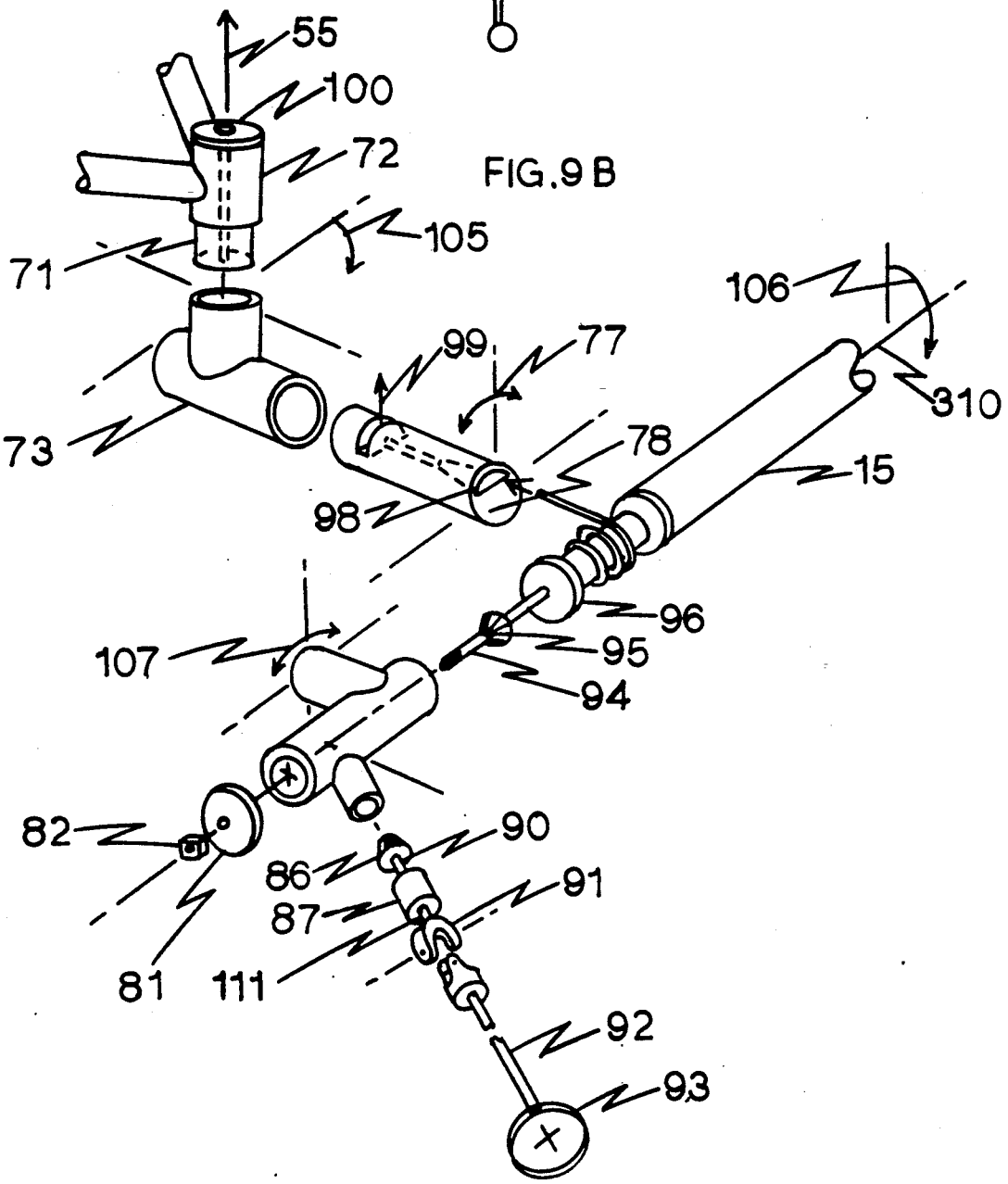
FIG.9B

FIG. 10A
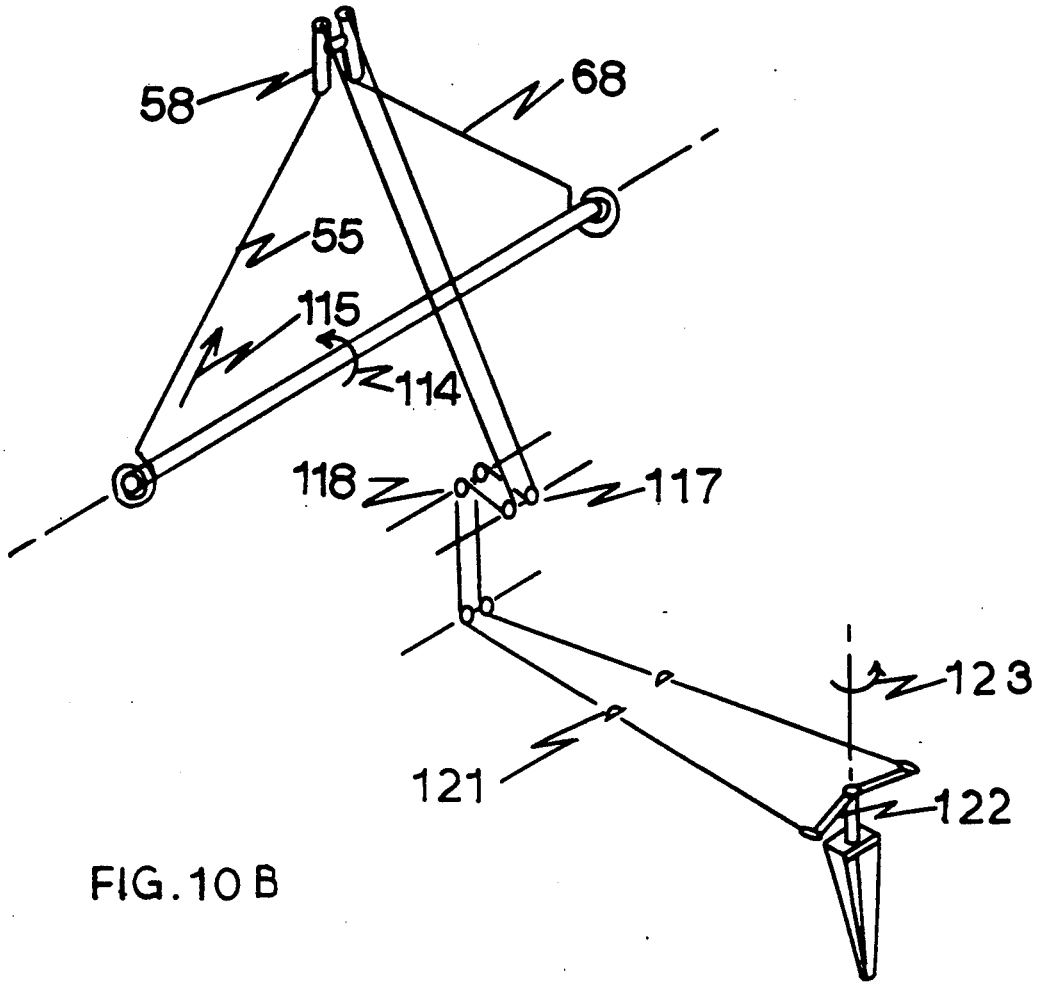
FIG. 10 B
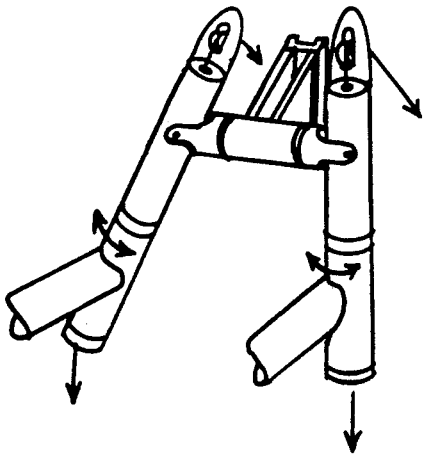
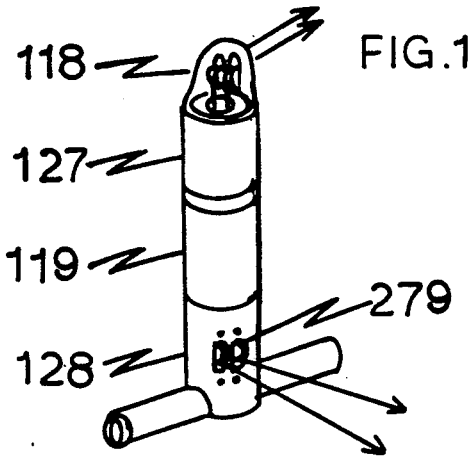
FIG. 10C 281
282
280
268

281
282
272
280

281
282
280
269

281
273
282
280

281
282
280
270

282
281
274
280

281
282
271
280

281
282
275
280

261
256
260

259

256

300
257

SAILBOAT

BACKGROUND OF INVENTION

The improved sailboat design (U.S Pat. No. 4,326,475, Apr. 27, 1982) has been built and tested in a "proof of principle" prototype. The size and complexity of this realization has prompted the smaller version at the other end of the size and complexity spectrum. Whereas the prototype weighs 1000 pounds, the deck has been reduced, and the number of lines and cables has been reduced. Furthermore, the relative sail area and usable deck space have been increased. The design is readily foldable and the sail configuration and control strategies are marked improvements on the earlier design.

The present invention relates to the sailboats in the form of multipontoon or multiple hull structures.

By way of background, attention is called to U.S. Pat. No. 4,326,475, Apr. 27, 1982 which forms the basis for the improvements herein described.

The improved sailboat described in the referenced patent was found to require improvements in the selected components. The following improvement needs have been identified during testing of the prototype design. The concept of steering the sailboat by relative rotation of the stern hulls relative to the bow hulls proved difficult due to friction in the mechanical device used to rotate the stern hulls. The jib and main sail configuration required many control lines (sheets). In addition, the mast in the center of the deck cluttered the deck area. Finally the design of the improved sailboat required connection of many cables and lines which led to a long setup and takedown time.

The object of the present invention is to provide a sailboat with the good features of the earlier patent design along with improvements to remedy the observed deficiencies in the earlier prototype.

A further objective is to provide a sailboat which can be folded and unfolded without extensive assembly tasks.

A still further objective is to provide a sailboat which can be quickly deployed yet constitutes a reliable and sturdy structure.

A still further objective is to provide a sailboat which provides the greatest sail area to weight ratio and associated high speed capabilities.

A still further objective is to provide a sailboat whose weight is easily handled by one person.

A still further objective is to provide a sailboat with maximum clean deck area per unit displacement.

A still further objective is to provide a sailboat capable of utilizing the counterbalancing weight of the helmsman to the fullest extent possible, yet assure the necessary controls are always within reach.

A still further objective is to provide a sailboat which is extremely trimmable, via the use of centerboards at the two bow vertices and the rudder behind the stern vertex.

A still further objective is to provide a sailboat whose hulls operate with a low drag under both displacement and planing modes.

A still further objective is to provide a sailboat which can be readily rolled on the beach, into and out of the water utilizing small wheels incorporated into the structure.

A still further objective is to provide a sailboat which utilizes a self buoyant closed foil rudder and an extended rudder support structure both to steer the boat as well as to change the hull orientation relative to the triangular deck for optimum sailing performance.

A still further objective is to provide a sailboat whose extended rudder structure can rotate about a horizontal axis to allow the rudder, whose buoyancy supports its weight, to follow the waves and not come out of the water, with possible attendent loss of control.

A still further objective is to provide a sailboat whose sails are constrained by a crossbar to remain approximately parallel under all sailing orientations thus assuring the maximum simplicity in sail control.

A still further objective is to provide a sailboat which has the capability to rotate the sails approximately 360 degrees, such that the sails can be used to the maximum lift/drag efficiency, even in downwind sailing.

A still further objective is to provide a sailboat whose sails' boom crossbar connection is used to both adjust sail orientation by horizontal translation as well as to steer the boat by rotation of the crossbar.

A still further objective is to provide a sailboat whose dual sail configuration naturally offsets the tendency of the wind to capsize the craft.

A still further objective is to provide a sailboat whose hull design has the minimum wavemaking drag under low speed displacement sailing and high stability and low drag under high speed planing conditions.

A still further objective is to provide a low drag closed foil rudder configuration with inherent self supporting buoyancy and elimination of tip vortex drag.

A still further objective is to provide a leading edge configuration on centerboards and rudder which reduce surface spray and associated drag losses.

A still further objective is &:o provide a sailboat with shock absorbers on each of the hulls to dampen fluttering under high speed sailing conditions and to also limit hull rotation about the horizontal axis avoiding potential hull "dig in" and pitch poling the craft.

Other objects are evident in the description that follows.

The foregoing objects are achieved, generally, in a sailboat that includes a rigid tetrahedral space frame that comprises three beams that form the sides of the deck triangle and two masts and a third mast support strut which are secured in close proximity to the vertices of the deck at one end and themselves at the top ends. The pontoons or hulls are positioned at the vertices of the triangle and secured to the space frame at said vertices.

SUMMARY OF THE INVENTION

Before going into detailed explanation of the invention with reference to the figures, some comments of a more general nature are made below. It should be noted that some of the terms are used loosely here to improve understandability. A more rigorous insight can be gained from the drawings.

The sailboat utilizes a tetrahedral space frame structure with the deck forming the triangular base and the two masts and the mast support strut forming the remaining three side edges of the tetrahedron. The overall design is configured and joined at the vertices of the tetrahedron to allow for folding of the structure into roughly a long cylindrical volume for transport purposes. Depending on the weight of the components, this folding process can occur both with or without the hulls being attached to the space frame. The folding process begins when the two masts are folded by unlocking the boom extension which tightens the forestay on each mast. Then allowing masthead connection to the mast support strut to slide along a track on the strut until the mast, sails and booms are completely folded. At this point the mast support strut is released from its locked upright position and lowered to the deck. The bow beam is then unlocked at its midpoint hinge and folded between the port and starboard beams, each vertex in the bow acts as a pivot point for one segment of the bow beam. The starboard and port deck beams are then folded scissor like until they are parallel and adjacent to each other, and the enclosed folded bow deck beam. The trampoline is also folded in place during this operation.

The present sailboat utilizes three hulls with the bow having two hulls and the stern having one hull. This configuration alows the maximum throat area for the wind to flow between the twin sails. The three hulls are constrained to remain parallel throughout their rotation range of approximately 120 degrees about the vertical axis of the vertex bearing at each corner of the deck. This is accomplished by bellcranks on each bow hull which are connected to the stern hull crank via tubes that transmit both tensile and compressive loads. The hull can be fixed at an intermediate rotation by means of a locking device at the stern hull. These different hull orientations allow the sail orientation to be optimized as well as to assure the maximum effective beam on different tacks. The angular orientation of the hulls relative to the deck is controlled by the rudder by means of the extending rudder structure. Under normal sailing conditions the hulls are fixed relative to the deck via locking of the stern hull and the only function of the rudder is steering the sailboat. The extended rudder support structure allows small rotation of the rudder with low attendent drag to have a large torque on the sailboat for steering. When changing tacks the hull rotation lock is released and the rudder rotation puts a large torque on the stern and bow hulls via an extended rudder support structure. The hulls rotate until the rudder is again aligned with the centerline of the rudder support structure and the hull rotation lock is allowed to reactivate by the helmspersons release of the lock control line above the boom crossbar.

The present sailboat utilizes the boom crossbar for three purposes. First, the boom crossbar maintains the twin sails in an approximately parallel orientation independent of the sail mast rotation. Second, the boom crossbar is used by the helmsperson to set sail angle to the wind. Third, the boom crossbar is utilized to rotate the rudder. This is accomplished by rotating the boom crossbar about its cylindrical axis. Rotation of the boom crossbar winds up one winch at the starboard sail side of the boom crossbar connection mechanism while it simultaneously unwinds the opposite side winch at the port side boom crossbar connection mechanism. Each winch has a line which connects to the corresponding side of the rudder bell crank. Opposite rotation of the boom crossbar moves the rudder in the opposite direction. The helmsperson standing on the trampoline stretched across the deck triangle holds the boom crossbar in both hands and has complete control of both sails' rotation and rudder rotation. It should be noted that the rudder control lines are configured to allow rotation of the sails and hulls without attendent binding of these lines or any influence of sails or hull orientation on the resultant rotation of the rudder. In a tacking manuever, a line which arches above the boom crossbar is pulled by the helmsperson with one hand to release the hull rotation lock mechanism. At the completion of the manuever the line is released and the hulls lock in the new tack orientation.

In order to allow steering and sail orientation control convenience two side handles are deposed at either end of the boom crossbar. These are connected so their rotation rotates the boom crossbar through a gearing arrangement. They are also rigid to allow for pushing or pulling the boom crossbar to orientate the sail configuration. A small universal joint is deposed between the handle rod and the connection to the gear to allow operation from different angles.

The design of the sail/mast configuration has a number of design aspects which enhance the overall objectives of the present sailboat invention. First, each mast folds at the connection point to the boom. Sail stays radiate out from this folding point and allow the sail with the stays and the boom to be folded.

Each mast has two side stays which are affixed to the masthead and foot while being constrained to pass through the centerline of the mast folding hinge. This allows folding, but rigidizes the mast for lateral deflection at the hinges when deployed.

The second aspect of each sail/mast configuration is the location of the approximate verticle axis of rotation of each mast. This axis which extends from the mast foot to the mast head almost bisects the surface area of the sail. This design assures that the windloads on the sail area are almost balanced about this axis and the resulting windload that the helmsperson must counteract through the boom crossbar is minimal, thus reducing the fatigue of sailing the sailboat of the current invention. In actuality the sail area between the axis and the boom crossbar is slightly larger than that of the area between the axis of rotation and the mast. This insures that the helmsperson must offset some wind load through the boom crossbar and thus has some feel for the sail performance.

The third design aspect of the sail/mast configuration is the capability of the sails to rotate through 360 degrees and be positioned at any desired angular orientation relative to the deck triangle. This is accomplished with the boom crossbar remaining attached to the booms and under the control of the helmsperson. This design thus allows for the leading edge of the sails to face the stern of the sailboat as well as the bow. Under the sail facing sternward conditions the sails can be oriented at the twenty degrees off the apparent wind and thus insure the maximum lift to drag ratio on the sails. In the upwind sailing mode the leading edge of the sails point toward the bow.

Again the sails can be set at 20 degrees off the apparent wind for the maximum lift. When sailing directly downwind the leading edge of one sail can be oriented so that it almost touches the trailing edge of the other sail. This configuration approximates a single spinnaker sail which provides lift as well as forward force on the sailboat of the present invention. The lift is generated because the axis of rotation is raked backwards from the vertical direction relative to the deck plane. The rake angle is adjustable via the control line which moves, and can lock the position of, the two masts along a track relative to the mast support strut.

The fourth design aspect of the sailmast configuration is the large distance between the masts at the deck elevation and the small distance between the mastheads at the top. This configuration yields a large throat area between the sails making them very efficient. As the sail chord gets smaller the resulting airflow boundary layer gets smaller and the required distance between the sails gets smaller without causing interference between the boundary layer of one sail and the air flow that the other sail "sees". Furthermore, this triangular configuration formed by the sails relative to the deck plane causes a wind force couple to be generated which resists the normal capsizing moment of the wind on the present sailboat design if the boat was on a broad reach relative to a similar boat having two sails with the plane of the individual sails perpendicular to the deck plane.

The sailboat of the present invention utilizes the two bow daggerboards and the rudder to control the leeward drift of the sailboat. For downwind sailing with the sails in a spinaker configuration, the bow daggerboards can be rotated upwards, thus reducing drag. When the sailboat is on a broad reach the effect of the wind load on the boat sails and structure is to "bend" the boat (if allowed to upon release of the hull rotation lock mechanism). The "bend" occurs at the stern hull vertex because of the location and associated leeward drag load on the bow daggerboards and the rudder. This configuration thus aids in configuring the boat so that the windward bow hull effectively becomes a outrigger of the sailboat of the present invention. Thus when the helmsperson releases the hull rotation lock, the wind load on the sails and the daggerboards and the rudder positions will make the sailboat configuration change require very little energy.

A further design feature of the daggerboards and the rudder are the serations built into the leading edge of the each daggerboard and the rudder in the waterline area. This serated edge prevents the generation of a spray of water up into the boat from each daggerboard under high speed sailing conditions, as well as reducing the drag load associated with this spray. These serations channel flow along the chord of the daggerboard or rudder and prevent the flow from turning and moving up along the leading edge thereby causing spray and a high drag load due to momentum change.

A further design feature of the bow hull daggerboards of the sailboat of the present design is the rollers built into the top section of the daggerboards. When the sailboat of the present invention is on land the daggerboards can be rotated to point forward and locked into position, this rotates the rollers into a position which allows the boat of the present invention to be rolled along the ground on the rollers. This manuever is carried out by the helmsperson picking up the stern of the boat using the extended rudder structure as a handle similar in function to a wheel barrow. The extended rudder structure can be used in this mode when its normal rotation about its hinge at the stern of the rear hull is made inoperable by a locking mechanism such as a tube indicated in the drawing. Thus if the sailboat was 150 pounds, the helmsperson would only have to lift 50 pounds because of the lever arm effect of the extended rudder structure.

A further feature of the present sailboat invention is the hull design. The hull operation in both the displacement and planing mode is made possible by means of both its constraint by the sailboat space frame and the limited degrees of freedom it can utilize, as discussed below. The two sides plates provide a channeling effect on the water passing beneath the hull. This assures that the water passing beneath the hull will generate the maximum lift on the hull, in addition to trapping air under the hull to provide a froth boundary layer between the hull and the undisturbed water upon which the hull moves. This froth has a lower coefficient of friction than just water under the hull. Secondly, the flat section of the hull at the bow, which just "kisses" the water surface, provides the pressure on the water going under the hull which offsets the virtual pressure which would ordinarily hold up the bow wave. Thus this shelf provides only a frictional type of drag load on the hull under displacement mode sailing. As the hull speed is increased the bow wave or nose of the hull starts dipping down until the hull rides on two planing steps formed by the first and second sharp edges under the hull. Further rotation in this direction is prevented by the shock absorber whose maximum extension is achieved at this point for the bow hulls and the maximum compression for the stern hull. This configuration thus allows the minimum drag under both displacement and planing modes and the planing mode is a highly stable configuration with the sharp edges which cause flow separation from the hull existing fore and aft of &:he hull horizontal pivot point. The load exerted by the water on the hull at these two points provides a balanced load relative to the fulcrum at the hull horizontal pivot bearing. In the event that the hull hits a wave and is slowed down significantly, it will just go into the displacement mode until enough hull speed is achieved for it to come into planing mode again. The degrees of freedom provided to the hulls by means of the attachment to the space frame allows the hulls to ride over turbulence and waves while preventing the hulls from rotating downward and potentially leading to "pitchpoling" of the sailboat.

BRIEF DESCRIPTION OF DRAWINGS

FIGS. 2D, 2E ,2F ,and 2G are diagrammatic illustrations of the mast stay configuration used to rigidize the mast in the deployed position yet allow folding without removal of the stays of the sailboat of FIG. 1;

FIG. 2I illustrates the location of the mast support strut floatation section which prevents complete capsize of the sailboat invention;

FIG. 2J illustrates the sailboat invention in the stable semi-capsized position utilizing the stern hull, one bow hull, and the mast support strut floatation device as the third point of floatation for the sailboat invention of the sailboat in FIG. 1;

FIGS. 6A, 6B, 6C and 6D are respectively a detailed isometric view showing the stern vertex extended rudder structure, and the self buoyant closed foil rudder, a sectional view of the self buoyant closed foil rudder, and a diagrammatic representation illustrating the operation of the extended rudder structure;

FIG. 9A and 9B show structual details of the dual booms and the boom crossbar connection of the sailboat of FIG. 1;

FIGS. 10A, 10B and 10C show structual details of the boom crossbar and steering control mechanisms of the sailboat of FIG. 1;

DETAILED DESCRIPTION

Figure 1:
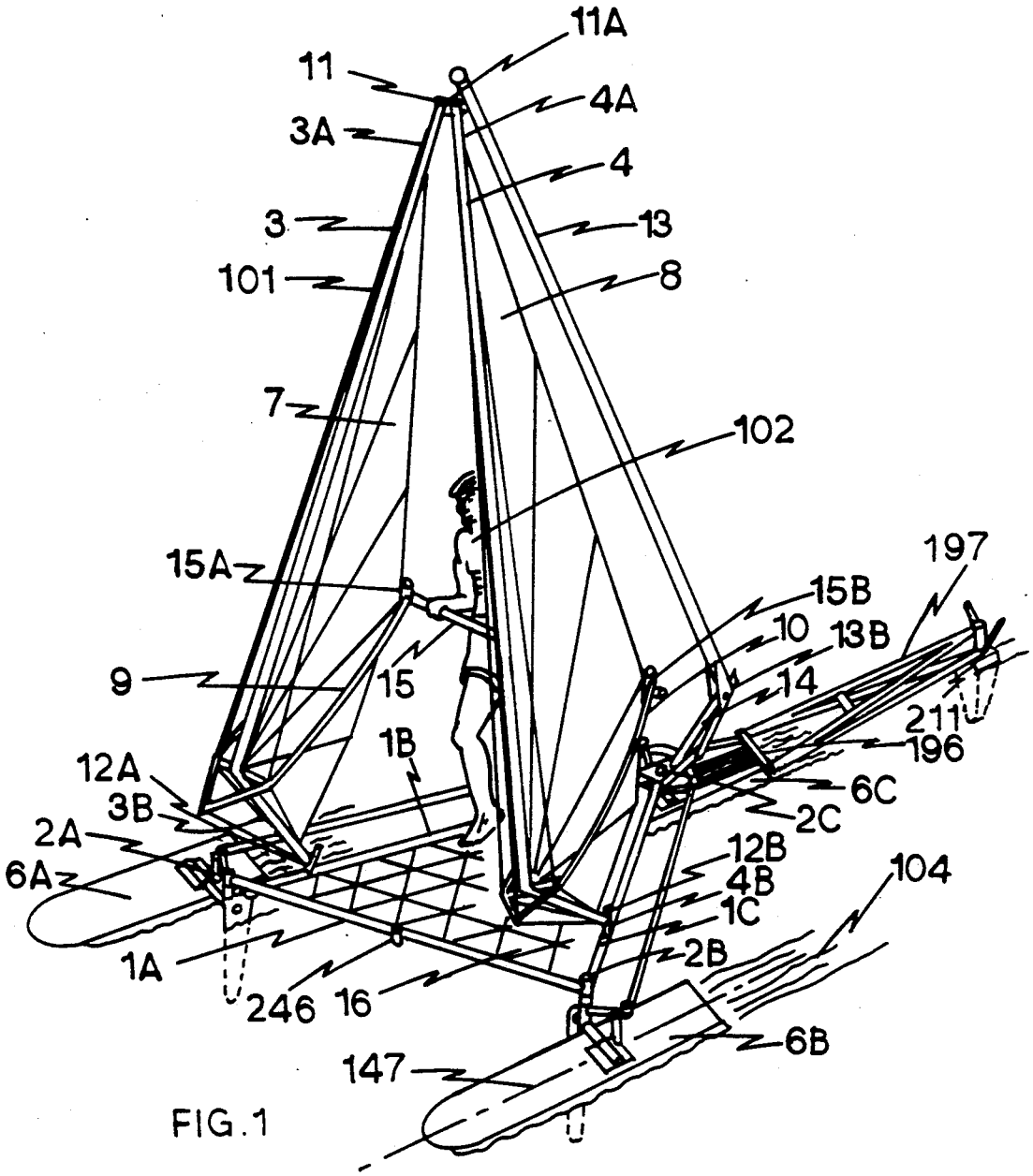
FIG. 1 is an isometric view of the three hulled sailboat of the present invention, sailing on a broad reach, said sailboat including a space frame.

Referring now to the drawings in greater detail, FIG. 1 illustrates a sailboat 101 with a helmsman 102 standing on a webbing 16 which serves as deck. The webbing 16 is stretched by its attachment to the triangular deck frame 1 along its perimeter. The triangular deck frame is comprised of three beams, the bow deck beam 1A, having a hinge 246 at the center of its length, the starboard deck beam 1B, and the port deck beam 1C. Each of the deck beams (1A, 1B and 1C) can be fabricated from an aluminum tube 10' long, with a 0.100 inch wall thickness and a 3.00" outside diameter. The port deck beam 1C and the starboard deck beam 1B are connected at the stern vertex assembly 2C. The bow deck beam 1A and the port deck beam 1C are connected at the port bow vertex assembly 2B. The bow deck beam 1A and starboard deck beam 1B are connected at the starboard bow vertex assembly 2A. The stern vertex assembly 2C also connects the triangular deck frame 1 to the stern hull 6C, the port bow vertex assembly 2B also connects the triangular deck frame 1 to the port hull 6B. The starboard bow vertex assembly 2A also connects the triangular deck frame to the starboard hull 6A. Later the three vertex assemblies, 2A, 2B and 2C, are presented in greater detail. The stern vertex assembly is also connected by beam 14 to the mast support strut 13 by means of a hinge 13B. Furthermore two mast assemblies 3 and 4 extend from the triangular deck frame to the top of the mast support strut. Mast assembly 3 is connected at its foot through fitting 3B to the starboard deck beam 1B and at its head 12A through fittings 11 and 11A to the top of mast support strut 13. Similarly mast assembly 4 is connected at its foot through fitting 4B to the port deck beam and at its head 12B through fittings 11 and 11A to the top of the mast support strut 13. Thus the approximate boundaries or edges of a tetrahedral shape are formed by the triangular deck frame 1, the mast assemblies 3 and 4 and finally the mast support strut 13.

Extending downward from the triangular deck frame 1 are three hulls: the starboard hull 6A, the port hull 6B, and the stern hull 6C positioned respectively at the three vertices 2A, 2B and 2C of the triangular deck frame and having two degrees of freedom, that is freedom of rotation in the horizontal plane and in the vertical plane, as later discussed. The stern hull 6C is connected to the extended rudder structure 197 through the stern vertex assembly. The stern hull can pivot about a third axis 303 FIG. 6A, in the vertical plane about a hinge pin 196 at the stern of the stern hull 6C FIG. 6A. The extended rudder structure acts as a connector between the stern hull 6C and the rudder 211 which also provides buoyancy to support the weight of the extended rudder structure 197. The sailboat 101 has two identical main sails 7 and 8. The respective wishbone booms 9 and 10 of each main sail 7 and 8, is of a length such that it can pivot about its respective sail head and sail foot 4A, 4B and 3A, 3B, as constrained by boom cross bar 15 which is connected to the leech end of each wishbone boom 9 and 10 respectively by connectors 15A and 15B. Many structural elements of the sailboat 101 that are shown in later figures are not, for simplicity, shown in FIG. 1. The sailboat 101 is sailing on a broad (port) reach: the water is labeled 104 in FIG. 1, merely to place the explanation in context. It is later shown that the boat 101 can be sailed by one person, although it can accommodate more. In the following, one person is assumed, he is the helmsman and he can move within the boundaries of the triangular deck frame 1 in tacking and reversing sail maneuvers as described shortly.

Figure 2A:
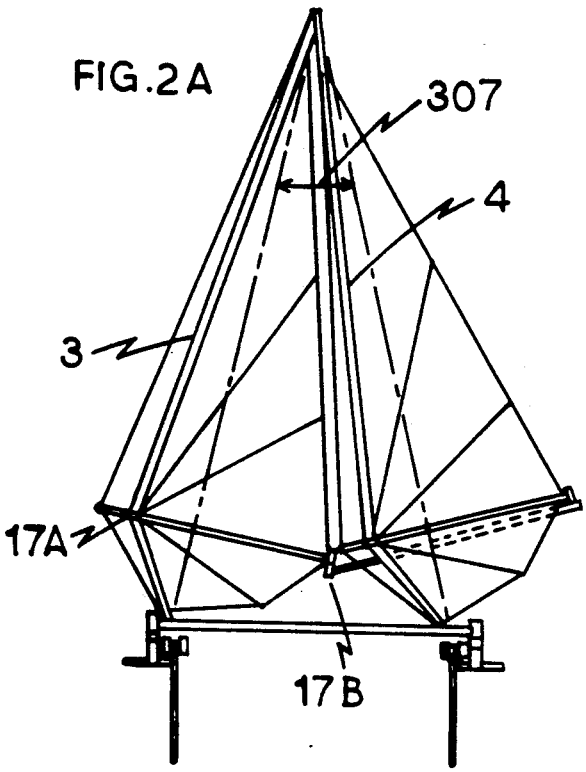
FIGS. 2A, 2B, and 2C are respectively a front view with sails oriented for downwind sailing, a side view with normal sailing configuration, and top view of the tetrahedral space frame (without hulls) of the sailboat of FIG. 1.
Figure 2B:
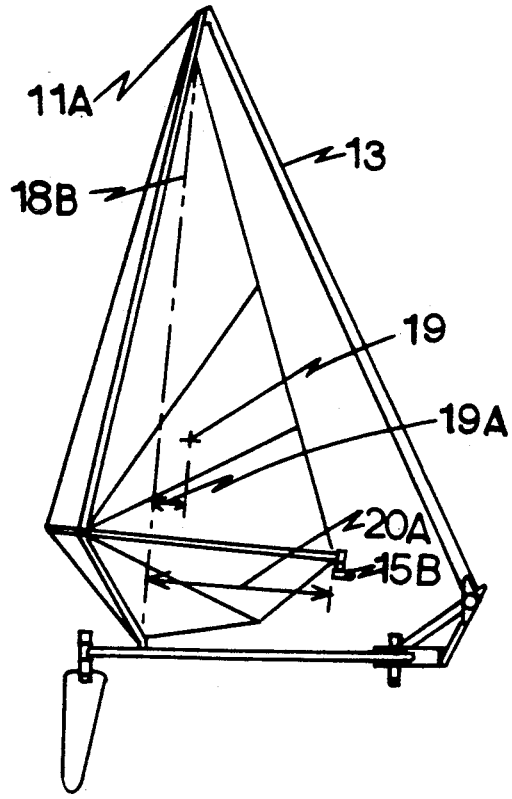
Figure 2C:
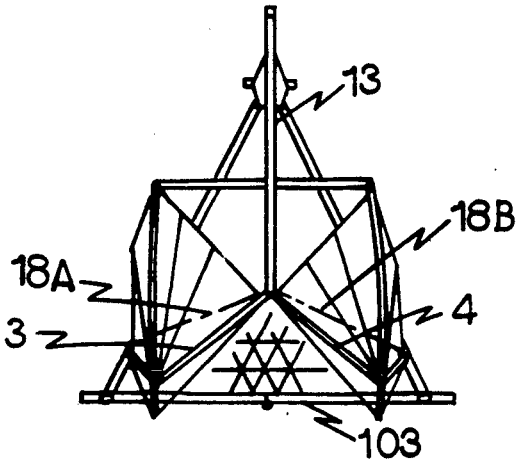

Previous mention is made to what is termed a tetrahedral-type space frame; a preferred form of space frame is shown at 103 in FIGS. 2A-2C comprised of the triangular deck frame 1 (shown without hulls), the mast assemblies 3 and 4 and the mast support strut 13. The mast assemblies and the mast support struts can be fabricated from aluminum tubing with a 0.050" wall thickness and a 2.00" outside diameter. The tetrahedral type space frame of the sailboat in FIGS. 2A, 2B and 2C is shown in its deployed configuration. The two mast assemblies 3 and 4 can be folded about mast knuckle joint hinges 17A and 17B respectively, while the mast heads slide down the mast support strut 13. This will be explained in more detail later.

This rigidized (deployed) space frame is thus capable of withstanding forces originating with the sails as well as forces emanating from the hulls. These forces tend to distort the space frame 103 and hence must be withstood for the frame to be mechanically stable. Furthermore in FIG. 2B it should be noted that the center of effort, or lift, of the wind on the port main sail shown 19, lies on the leech side of the axis of rotation 18B, the same is true on the starboard sail. The distance 19A between the axis of rotation of the sail and the center of lift on the sail, is the lever arm of the sail lift force which must be overcome by the pull of the helmsman 102 in FIG. 1. Since the pull of the helmsman acts over the much greater lever arm 20A from the axis of rotation 18B to the boom cross bar connection 15B, it minimizes the helmsman's fatigue in a simple fashion.

The details and features of one typical mast assembly configuration are illustrated in FIG. 2D for mast assembly 4. The mast assembly is comprised of a lowermost segment 22 shown in FIG. 2G which incorporates the foot of the mast 4B (not shown) which in turn is connected to a mast foot support swivel (12B FIG. 8B) which allows rotation of the mast assembly 4 about its axis of rotation 18B FIG. 2B. The upper end of the lowermost segment 22 has a tubular component 30 which is part of the mast assembly knuckle joint hinge. The hinge pin 24 FIG. 2D (made from Delrin or a similar material) provides both a bearing and a shaft function for the mast assembly knuckle joint. In the final assembly of the mast the hinge pin 24 passes through the tubular component 30 in the lowermost segment 22. The lower mast segment 22 FIG. 2D has 3 drilled plates affixed to it (not shown) to which turnbuckle means (not shown), are affixed to tension cables 25, 26 and 27. The uppermost segment 21 shown in FIG. 2D of the mast assembly 4 has two side plates 31 which have holes in them (not shown) to receive the pin 24 in the final assembly. The head of the uppermost segment 21 FIG. 2D has 3 drilled plates (not shown) affixed to it to provide upper attachment points for cables 25, 26 and 27. The lower end of the uppermost segment FIG. 3B has a stop (not shown) to prevent opening of the mast segments about its mast assembly knuckle hinge joint greater than an angle 43 (approximately 110°). The wishbone boom component 10 of the mast assembly 4 similarly has tubular fittings (not shown) on each "arm" to receive the pin 24 in the final assembly. The leech end of the boom has a small plate 34 with a hole in it (not shown) to receive the sail leech tensioning sheet, and also a small eye 35 FIG. 2D to receive the hull lock release line.

The mast assembly requires a locking device 17B, FIG. 2F shown in detail in FIGS. 2F and 2G. In FIG. 2G the locking device in the unlocked position and is rotated so that it lines up with line 43, in this position the fore cable 27 is loose and the mast can be folded about the mast knuckle joint hinge pin 24 FIG. 2D. In the deployed position the locking device is rotated so that it lines up with line 44 FIG. 2F. This tensions the cable 27 until the locking device 17B FIG. 2F comes in contact with the ball stop 45 FIG. 2F on cable 27. This ball stop is located so that it allows the locking device to pass the point of incurring the maximum cable stress in cable 27, thus the locking device is in a stable locked position. The helmsman performs this locking action manually. Thus the mast is constrained in a rigid configuration by the tension in cable 27 offsetting the sail tension, which tends to fold up the mast into configuration shown in FIG. 2G. The locking device 17B FIG. 2F is affixed to the hinge pin 24 (fabricated from 1.25 inch solid delrin rod) by spreading the two arms 46, 47 FIG. 2D of the wish bone boom so that they slip over the mast knuckle joint hinge pin 24. The tubular ends of these arms fit snugly over the ends of the hinge pin 24 and are pinned in place. The cables 25 and 26 pass through the axis of rotation of the mast knuckle joint hinge pin 24 FIG. 2D. This allows folding and unfolding of the mast without significant changes in cable 25 and 26 length and hence tension. The lowermost segment 22 and uppermost segment 21 FIG. 2G have a small clip affixed to them to fasten the foot and head end of the sail to the mast assembly (not shown). Cables 25 and 26 FIG. 2D rigidize the mast to lateral wind load induced bending.

The principle characteristics of the sails 7 and 8 as shown in FIG. 1 are the radial battens which lie along radii emanating from the axis of the mast assembly knuckle joint hinge pin (24, FIG. 2D). The leech sheet for tensioning the sail leech uses the hole in plate 34 FIG. 2D. The sail clips, at the head and foot of each of the mast segments prevent the sail from sliding toward the mast assembly knuckle hinge joint. The sail slides over the mast segments 21, 22 in FIG. 2G when the mast is in the folded position and the cables 25, 26 and 27 are not attached. Once the mast assembly and sail are completed i.e., cables 25, 26 and 27 fixed as indicated in FIG. 2D the sail does not have to be removed, it is just folded or deployed along with the mast segments. The sail leech connection 34 FIG. 2D to the wishbone boom 10 FIG. 2D serves to hold the wishbone boom from rotating downward as well as to tension the sail leech. It should be noted that other means of attachment of the sail to the mast segments are possible but the battens must have the radial configuration (shown in FIG. 1) to allow the folding function of the mast assembly knuckle joint hinge to be accomplished without sail removal.

Figure 2H:
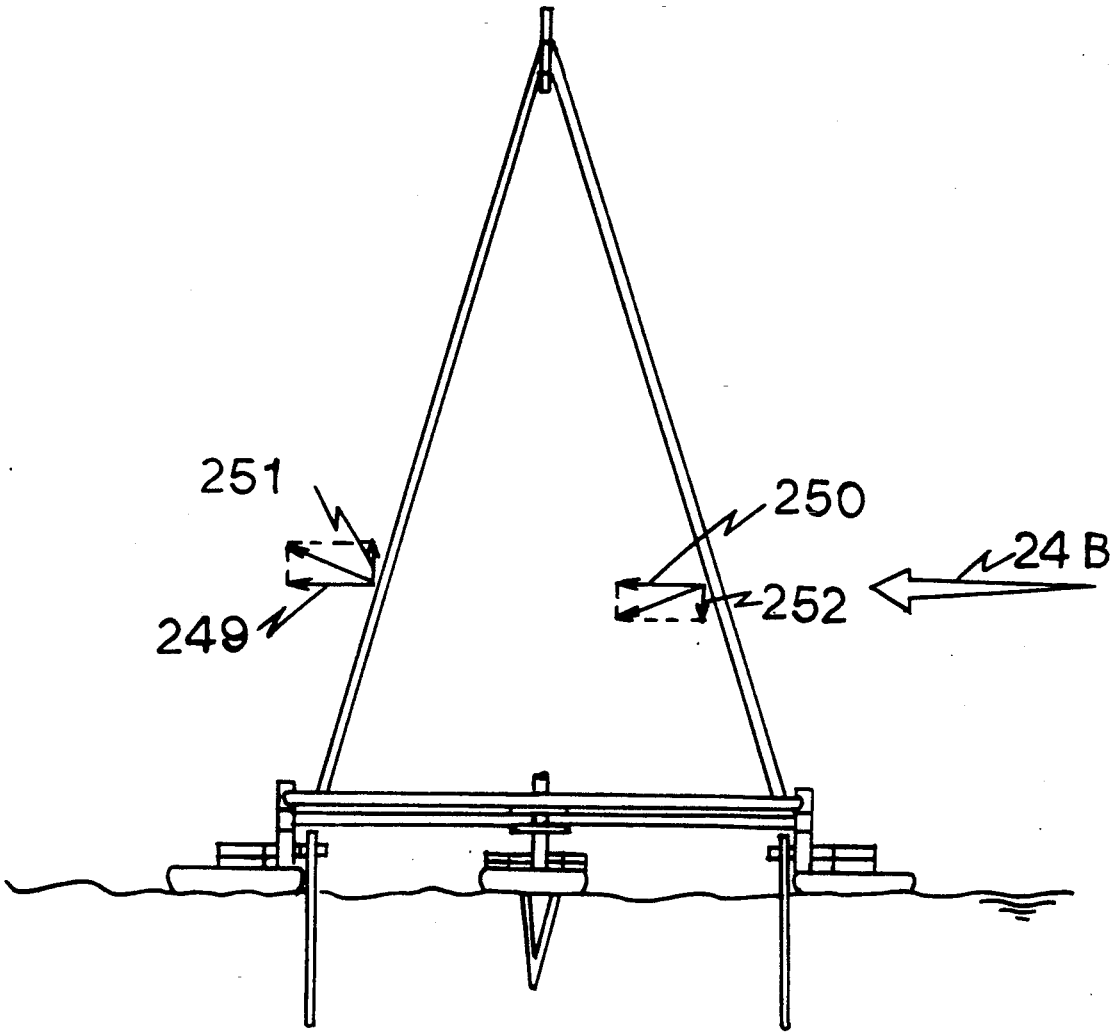
FIG. 2H illustrates the idealized wind load on each sail showing the horizontal components and vertical components. These vertical components form a force couple opposing the wind capsizing load on the sailboat invention of the sailboat in FIG. 1.

FIG. 2H shows the wind indicated by arrow 248 acting on the sailboat on an idealized broad reach, the lift load on each sail can be resolved into vertical and horizontal components. Loads 249 , and 250 push the boat sideways. These sideward forces are resisted by the rudder and the two daggerboards, yielding forward motion. Loads 251 and 252 form a force couple which actually resists the overturning moment caused by the wind, this is due to angle 3 of FIG. 2A. In the event that the sailboat is tipped over as shown in FIG. 2J the bow hull 6A and the stern hull 6C (not shown) will rest on the water. The mast heads 3A, 4A and the top of the mast support strut 13 will provide floatation because they are sealed at the top and bottom respectively and will prevent complete capsize. Rerighting the sailboat is facilitated by this configuration.

Figure 3A:
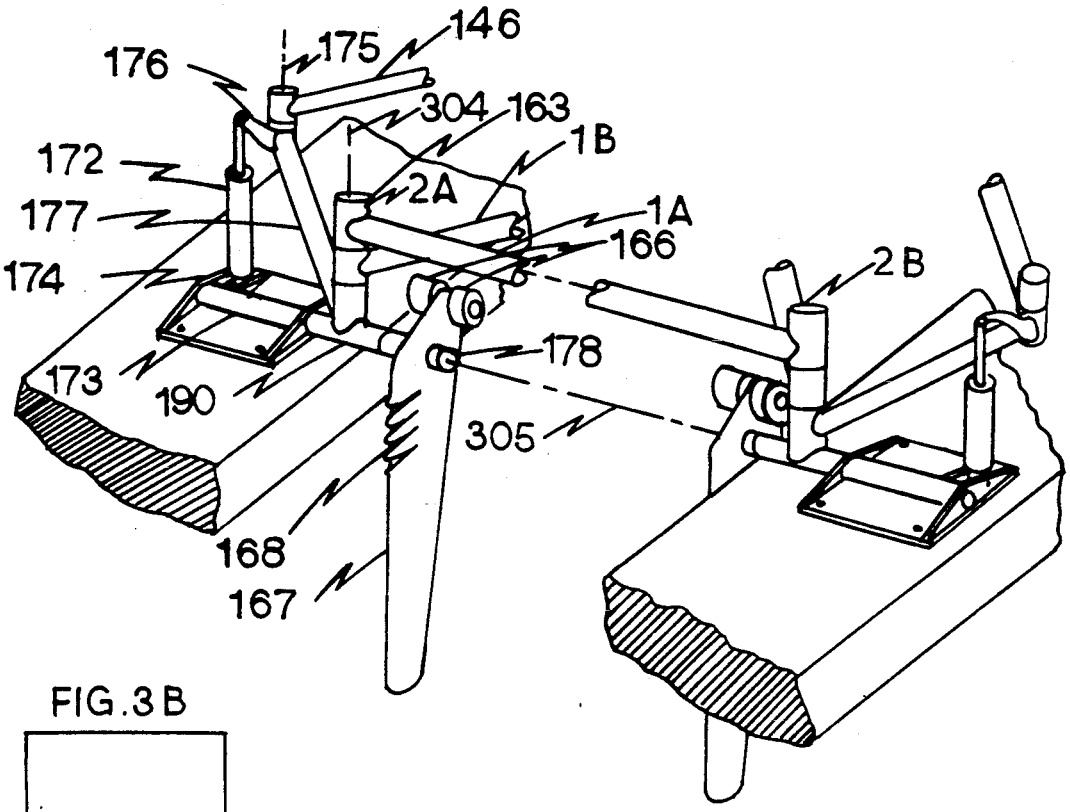
FIGS. 3A, 3B, 3C are respectively a detailed isometric view showing the starboard bow vertex assembly component, a top view and a front view of the starboard bow vertex of the sailboat of FIG. 1.
Figure 3B:
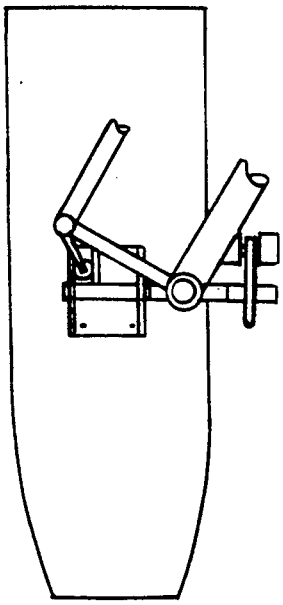
Figure 3C:
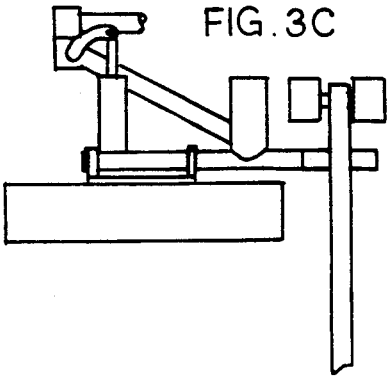
Figure 4A:
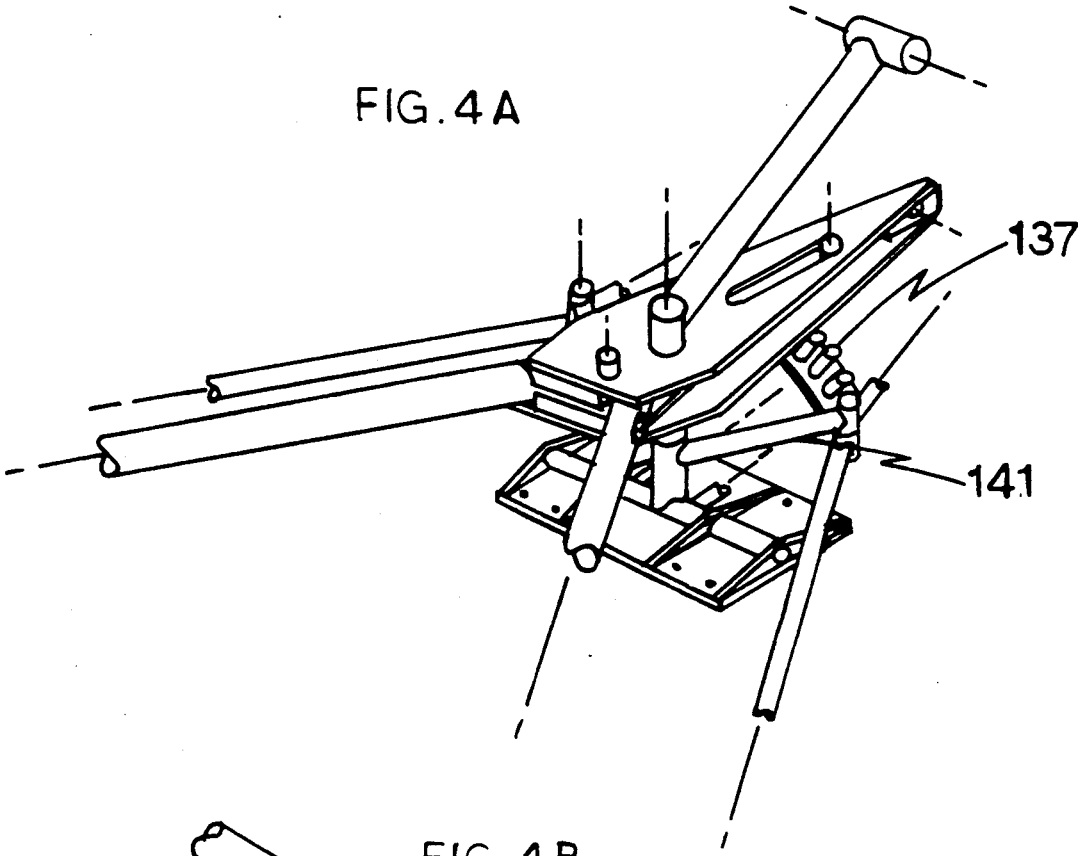
FIGS. 4A, 4B, 4C ,4D are respectively a detailed isometric view showing the stern vertex assembly elements, a top view, a side view and an exploded view of the stern vertex of the sailboat of FIG. 1.
Figure 4B:
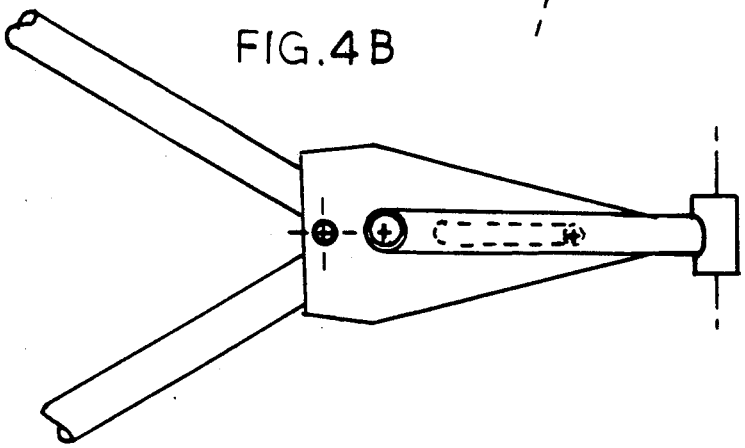
Figure 4C:
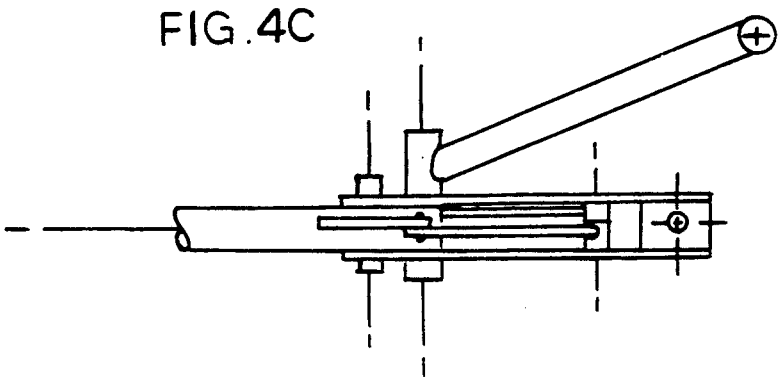
Figure 4D:
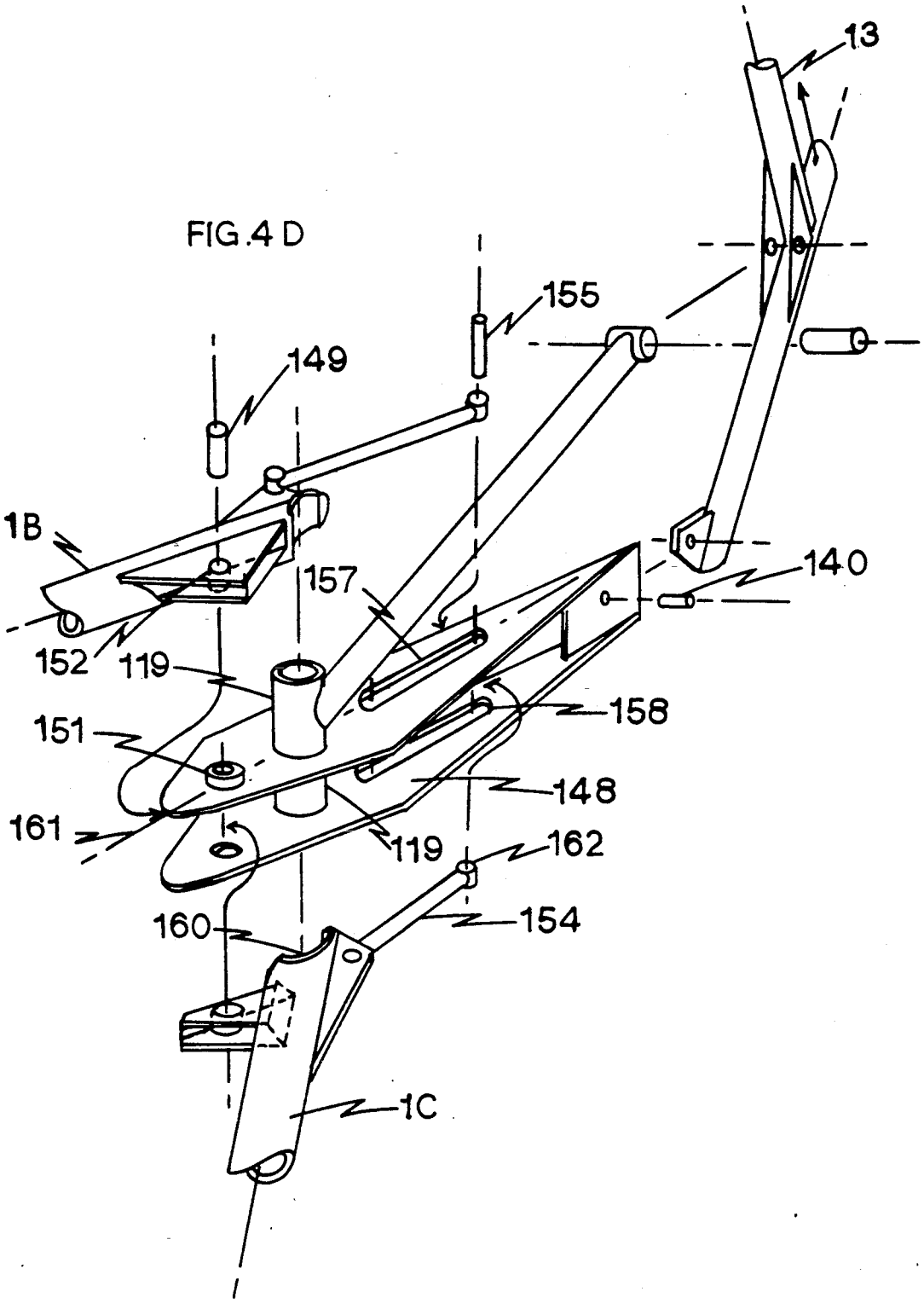
Figure 5:
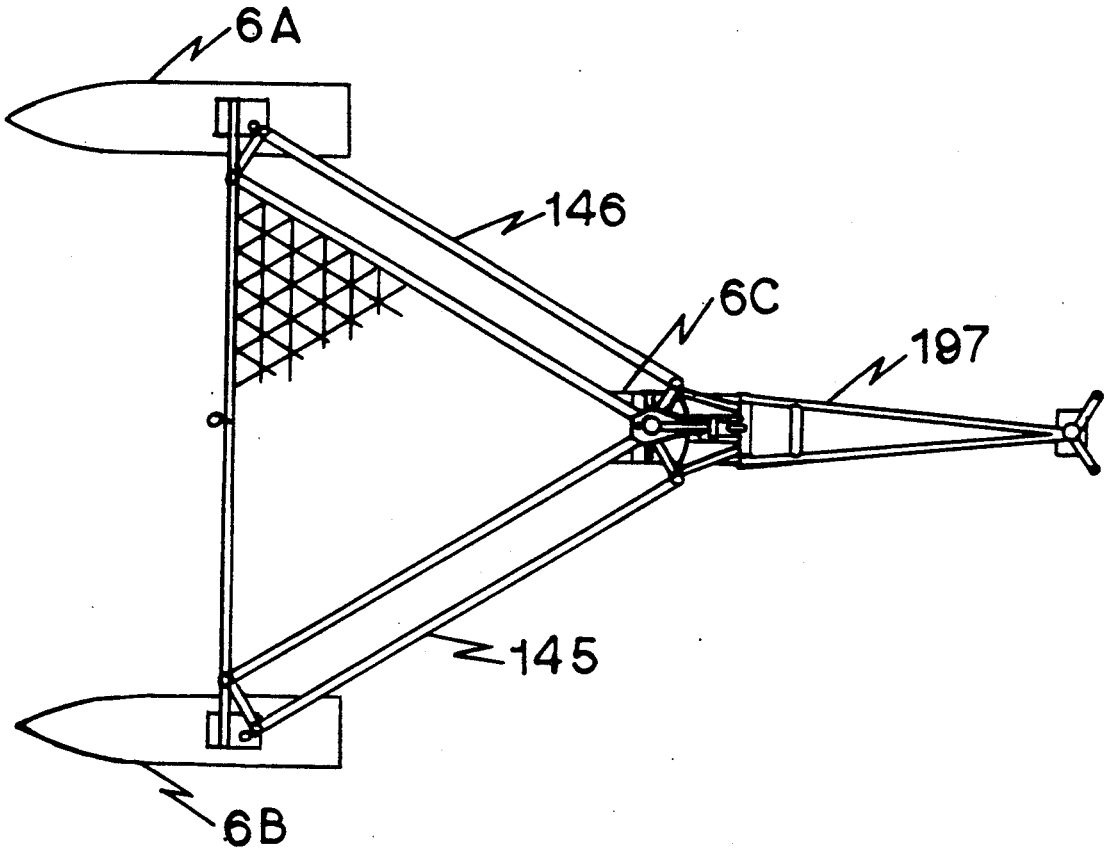
FIG. 5 is a plan view showing hull orientations of the sailboat of FIG. 1 and an idealization of the, interconnections between the bow hulls, stern hull and the extended rudder structure.
Figure 6A:
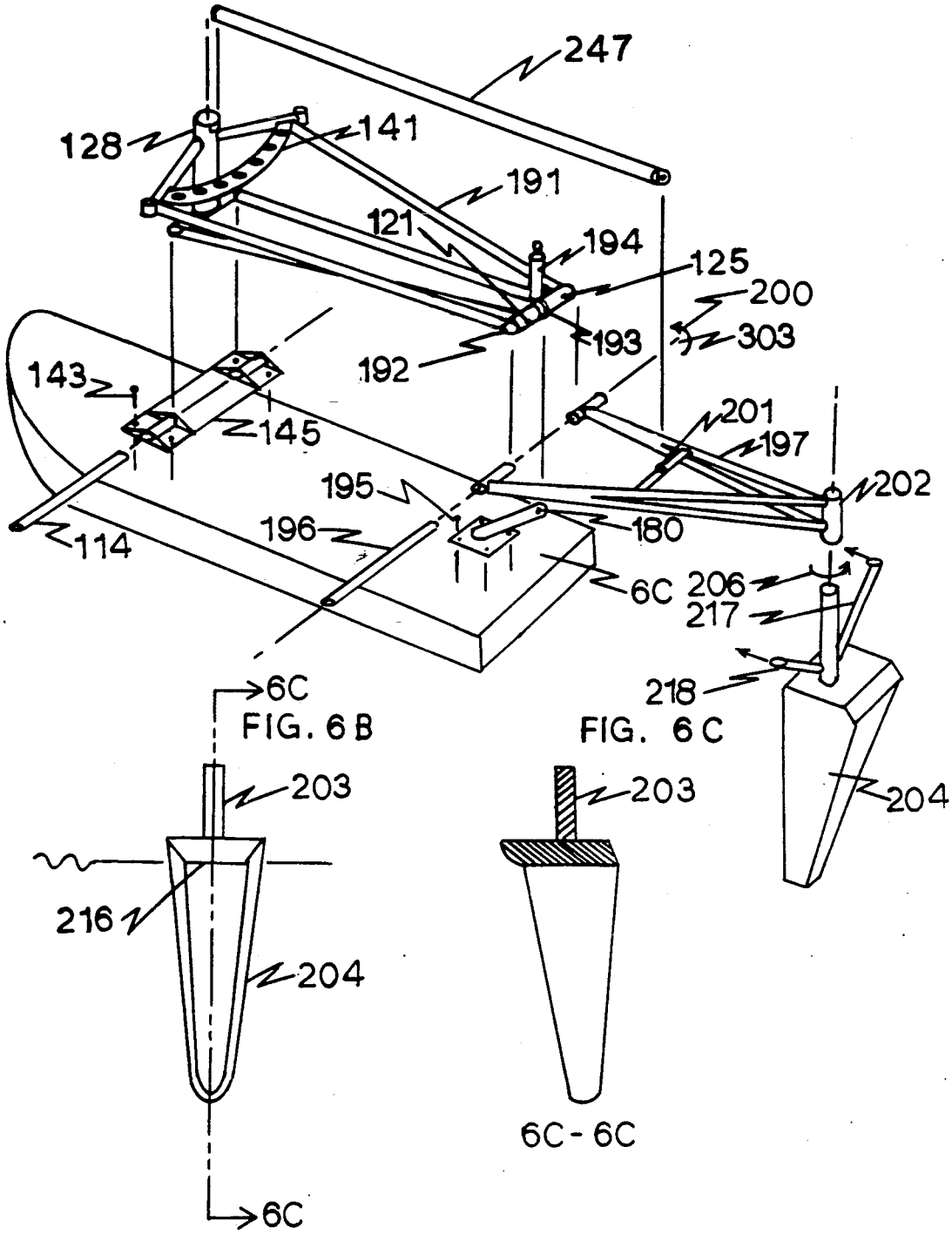
Figure 18A:
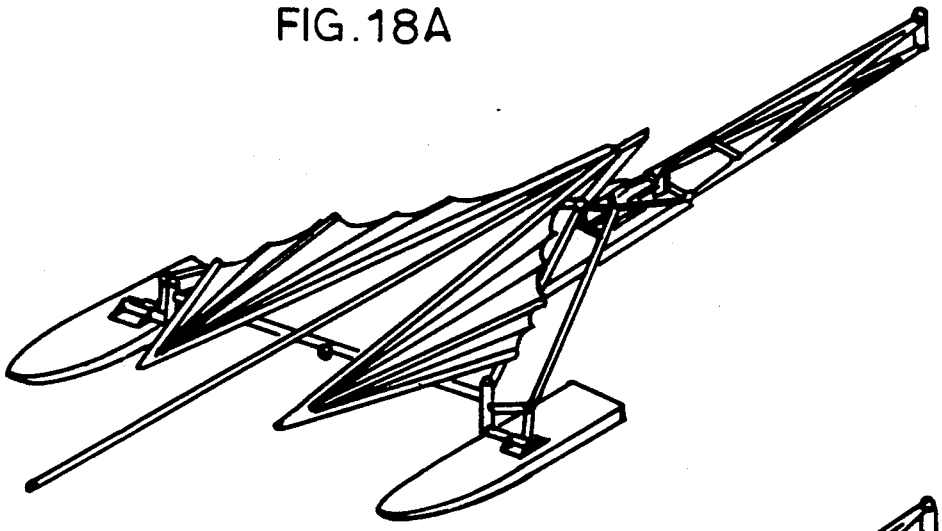
FIGS. 18A, 18B and 18C show the folding sequence for the sailboat of FIG. 1.
Figure 18B:
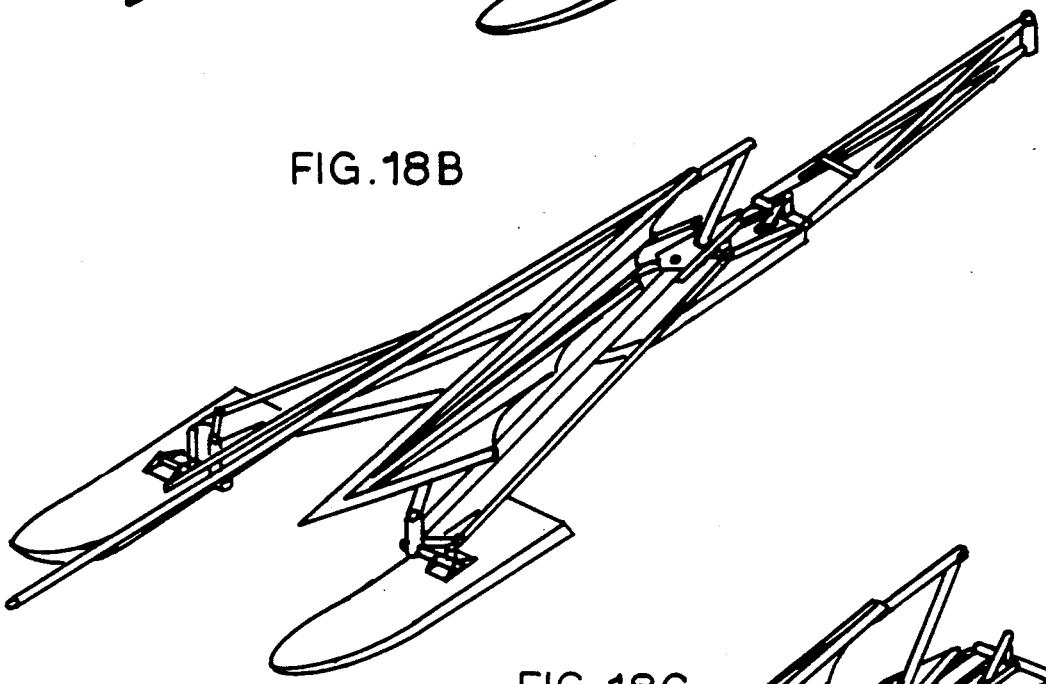
Figure 18C:
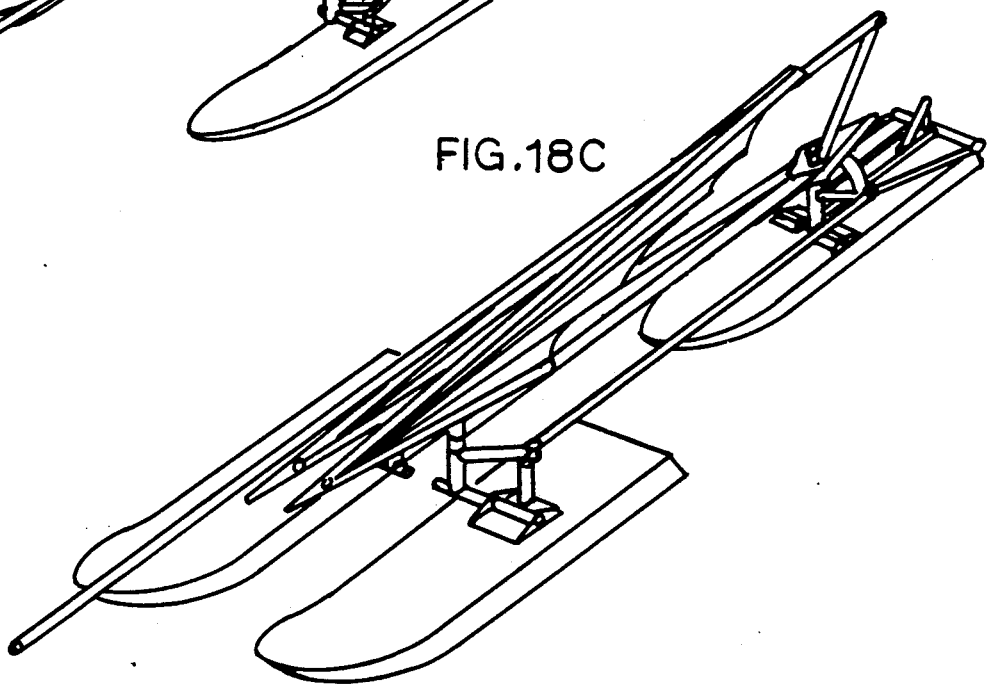

FIG. 3A shows details of the starboard bow and port bow vertex assemblies 2A and 2B. Starboard deck beam 1B which is connected to the stern vertex 2C FIG. 1, is also connected to vertex 2A by means of hinge pin 163 which is riveted into component 190 of vertex 2A FIG. 3A. The hinge pin 163 allows for rotation of the starboard deck beam and the bow deck beam about the first axis 304 FIG. 3A. The corresponding hinge pins in the port bow vertex and the stern vertex assemblies serve similar purposes and allow similar rotation about the respective first axis of each vertex's hinge pin. Hinge pin 163 passes through deck beams 1B and 1A which are constrained to remain on the hinge pin 163 axially by a locking means (not shown). Bell crank arm 177 FIG. 3A is connected to tube 146 through pin 175 thus the rotation of bell crank 177 FIG. 3A causes a like rotation in the remaining two bell cranks and hulls as shown in FIG. 5. Bell crank 177 also has a bracket 176 for holding one end of a shock absorber 172. The other end is fixed to a bracket 174 which is part of the hull bearing block 173. The shock absorber dampens hull rotation about hinge pin 178 and also limits rotation of hull 6A as shown in (FIGS. 20A and 20D) when it reaches full extension and full compression respectively. The daggerboard 167 FIG. 3A can rotate about the second axis 305 through the hinge pin 178, the starboard hull can also rotate about this second axis 305 on hinge pin 178. The port and stern hulls similarly can rotate about their respective second axes. FIG. 11A shows the board 167 in its full down position but it can be raised and locked at different positions of the locking pin not shown. The top section of daggerboard 167 has two wheels 166 affixed to it which are used in moving the sailboat over the beach region before launching as shown in FIG. 19D. The daggerboard also has grooves 168 in it to eliminate spray formation under sailing conditions (see FIG. 21). Daggerboard 167 rotates about hinge pin 178 and is prevented from sliding off it by a locking ring (not shown). The stern vertex 2C FIG. 4A has a bell crank 141 with multiple locking orientations 137 FIG. 12 (typical) affixed to it as shown in FIG. 6A. FIG. 4D is an exploded view of the stern vertex assembly (2C FIG. 1). The connection between the mast support strut 13 FIG. 1 and the stern vertex 2C FIG. 1 is shown in FIG. 4D. The segment 128 FIGS. 6A, of the 2C vertex assembly is connected to the stern hull 6C FIG. 1 by the hinge pin, 144 FIG. 6A, through the mounting bracket 145 FIG. 6A, which in turn is fixed to the stern hull 6C by four bolts (143 FIG. 6A being typical). The vertex 2C FIG. 4D forms an integral part of the assembly 148, in which port deck beam 1C and starboard deck beam 1B (FIG. 1) are constrained to rotate about hinge pin 149. Pin 149 passes through hole 151 then through hole 152 in the starboard deck beam 1B then through a hole through a similar component of the port deck beam 1C and is then locked in place by a pin (not shown). When the triangular deck frame 1 FIG. 1 is fully deployed the angle between the starboard and port deck beams 1C and 1B respectively is 60° and the cutout 160 in the port deck beam 1C fits around 180° of the tubular segment 119 circumference. Similarly, the starboard deck beam 1B fits around the remaining 180° of the tubular segment 119 circumference. The axis 161 of assembly 148 which passes through the center of the slot 157 always bisects the angle between deck beams 1C and 1B. This is maintained by arm 154 on port deck beam 1C and a corresponding component of the starboard deck beam 1B. The arm 154 has pin 155 passing through its tubular end 162 as well as slots 157 and 158. A lock pin (not shown) holds sliding pin 155 in place in hole 162. Pin 155 moves to the extreme sternward end of the slots 157, 158 in the deployed configuration of the triangular deck frame 1, FIG. 1 and to the end closest to segment 119 in the folded configuration of the triangular deck frame (FIG. 18C).

FIG. 5 shows a top view of the deployed triangular deck frame 1 FIG. 1 with hulls 6A-6C FIG. 1 and the extended rudder structure assembly 197 FIG. 6A and the bell crank tubes 145, 146 which are used to maintain hulls 6A, 6B and 6C parallel with respect to their long axis, 147 FIG. 1, (typical of each hulls long axis). FIG. 6A shows the extended rudder structure 197. Bell crank 141 is connected to extended rudder structure 197 FIG. 6A by means of a bearing shaft 196 and tube 192. Bearing tube 192 has fairleads 121 and 125 FIG. 6A affixed to it which guide the rudder control cables (55, 68 FIG. 10A) as well as connector 193 FIG. 6A, to which the shock absorber 194 FIG. 6A is connected at its lower end. The top of the shock absorber 194 is pinned to housing 180 FIG. 6A which in turn is bolted on to the stern hull 6C by four bolts 195 FIG. 6A (typical). The shock absorber 194 is in its fully compressed configuration when hull 6C is in extreme bow up configuration (not shown), and in its fully extended configuration when hull 6C is in its full planing orientation (FIG. 20D). The extended rudder structure 197 is connected to the tubular bearing 192 by means of pin 196 which is held in place by two locking rings (not shown). The extended rudder structure 197 can move as indicated in the direction 200 FIG. 6A. This is required to allow the rudder to follow the sea and not be pulled out of the water (as would happen in a standard rudder attachment to the hull of a sailboat) in going over a wave (see FIG. 6D). The hinge pin 196 FIG. 6A is located just past the stern of hull 6C so that the extended rudder structure 197 FIG. 6A will not impact the stern of hull 6C FIG. 1. The extended rudder structure 197 6A terminates in a vertical tubular bearing 202 FIG. 6A, 6B which holds hinge pin 203 FIG. 6B (i.e., made of delrin or similar material). The rudder rotates about pin 203 FIG. 6B as shown by arrow 206 FIG. 6A. FIG. 6B shows the rudder assembly 204 in more detail. The top of the rudder hinge pin 203 fits into the tubular bearing 202 FIG. 6A and is locked in place axially by lock ring (not shown). Rudder hinge pin 203 FIG. 6B fits through the tubular bearing section 202 of the rudder assembly 204 FIG. 6A. The rudder assembly 204 FIG. 6B is a hollow light structure designed to provide floatation sufficient to support the weight of the extended rudder structure 197 FIG. 6A as well as to allow the bottom surface 216 FIG. 6B to just "kiss" the surface of the water. The rudder can be made of metal (i.e., 0.030 inch thick aluminum) sheet. FIG. 6C illustrates a sectional view of rudder 204. The rudder assembly 204 FIG. 6A has port and starboard "arms" 217, 218 that are used to rotate the rudder via cables 55, 68 FIG. 10A.

Figure 6D:
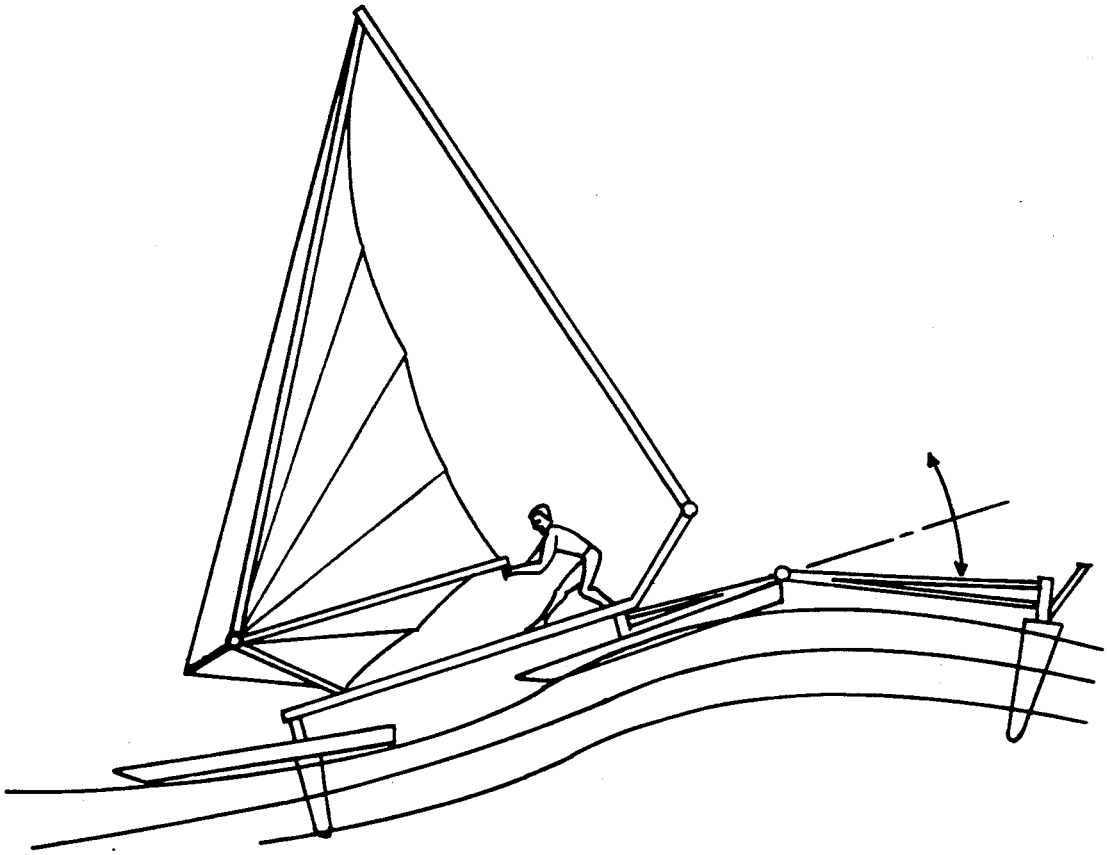
Figure 7A:
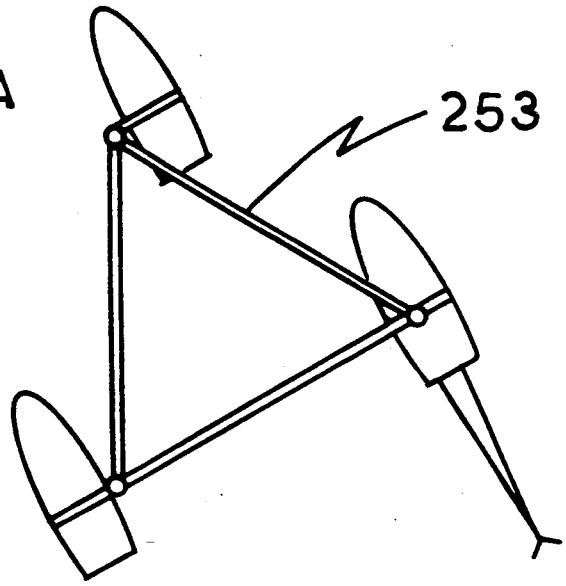
FIGS. 7A, 7B, and 7C are diagrammatic representations of the three possible orientations of the hulls relative to the triangular deck frame of the sailboat of FIG. 1.
Figure 7B:
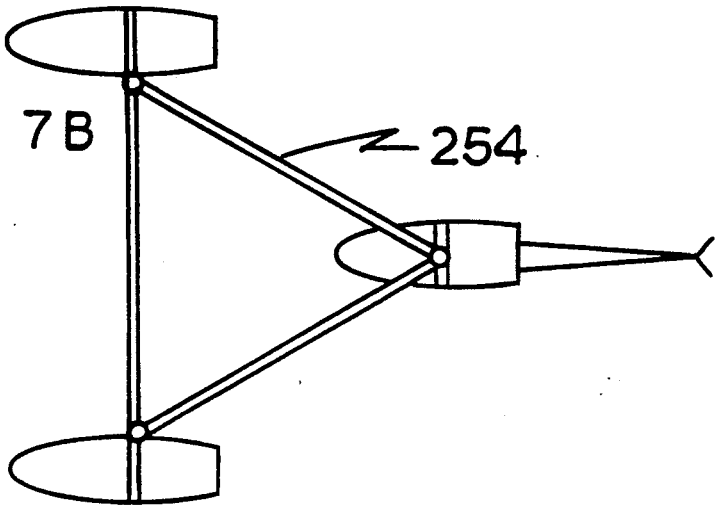
Figure 7C:
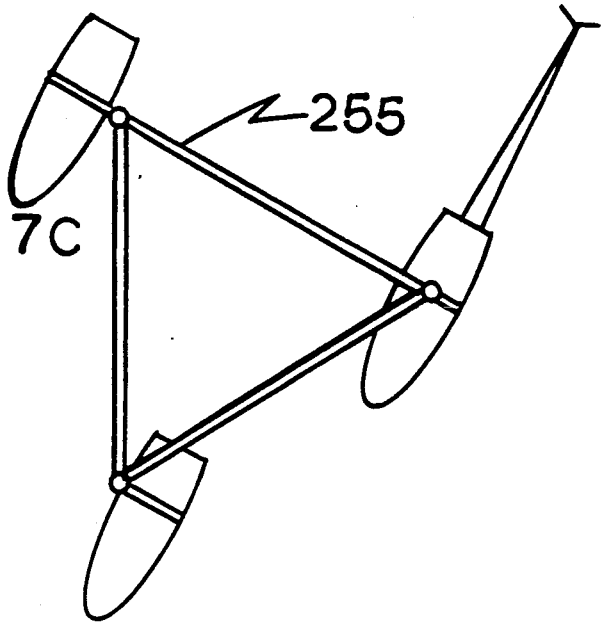
Figure 12:
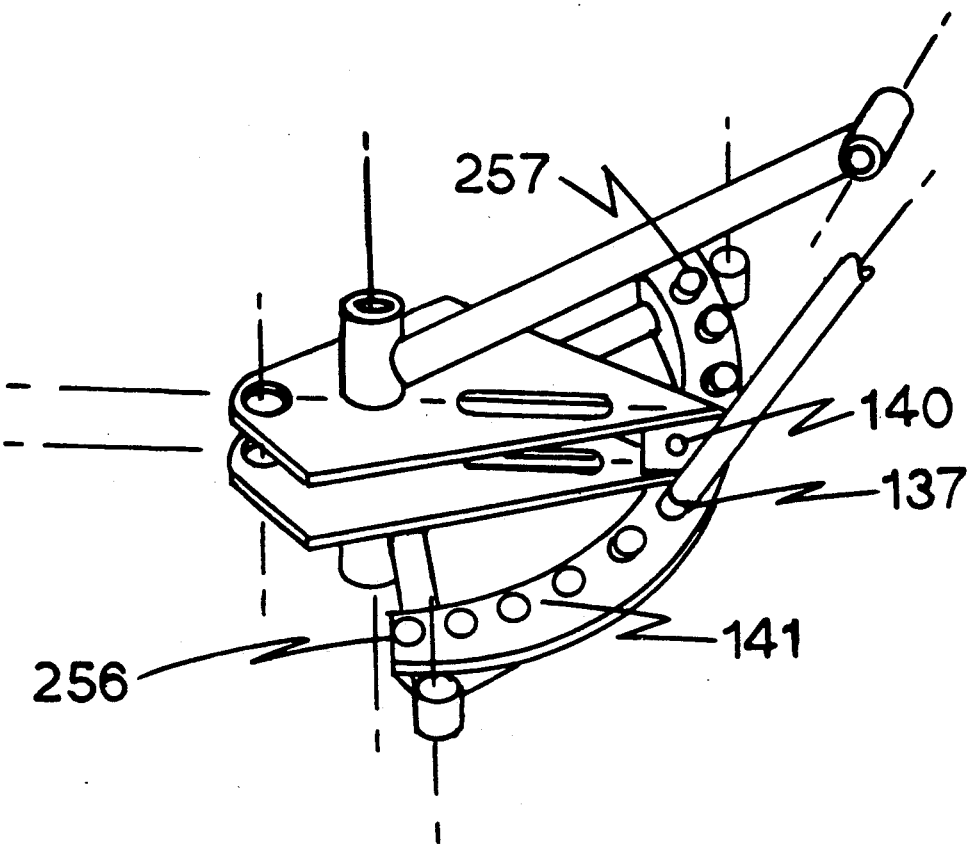
FIG. 12 shows structual details of the mechanism used to fix the hull orientation of the sailboat of FIG. 1.
Figure 13A:
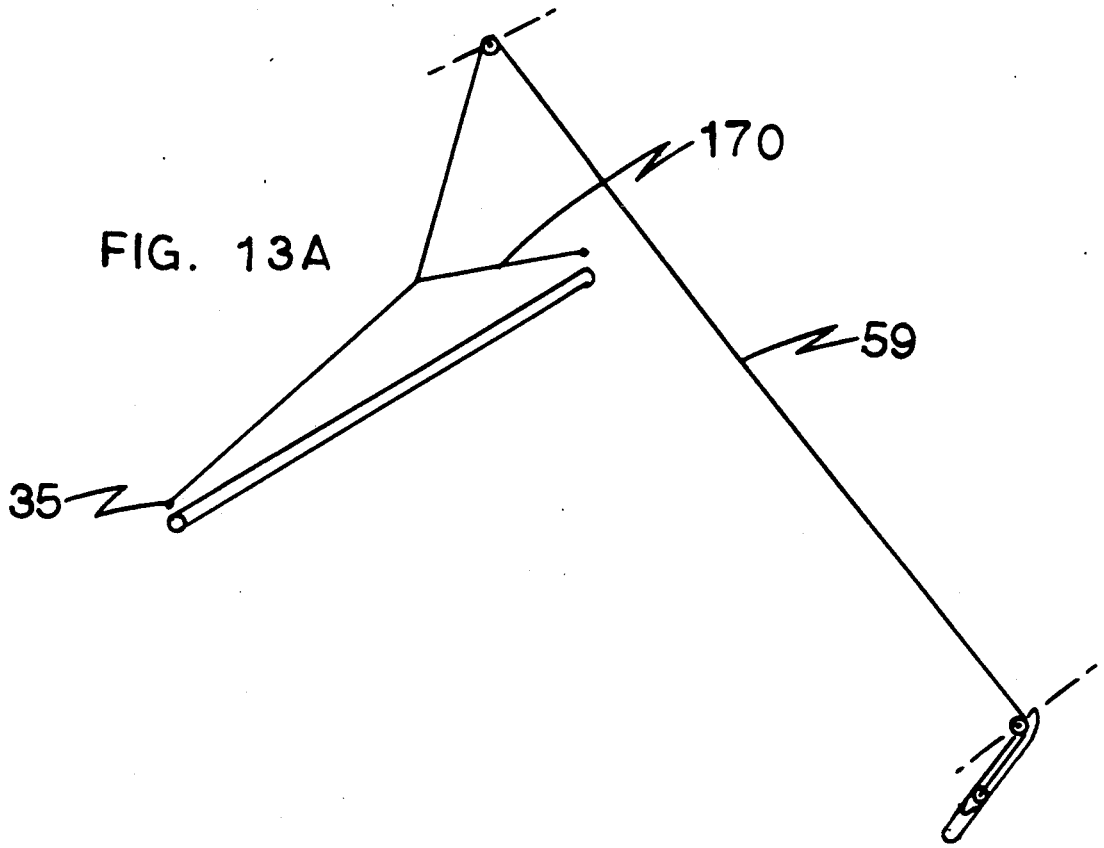
FIGS. 13A and 13B show details of the stern hull locking mechanism of the sailboat of FIG. 1.
Figure 13B:
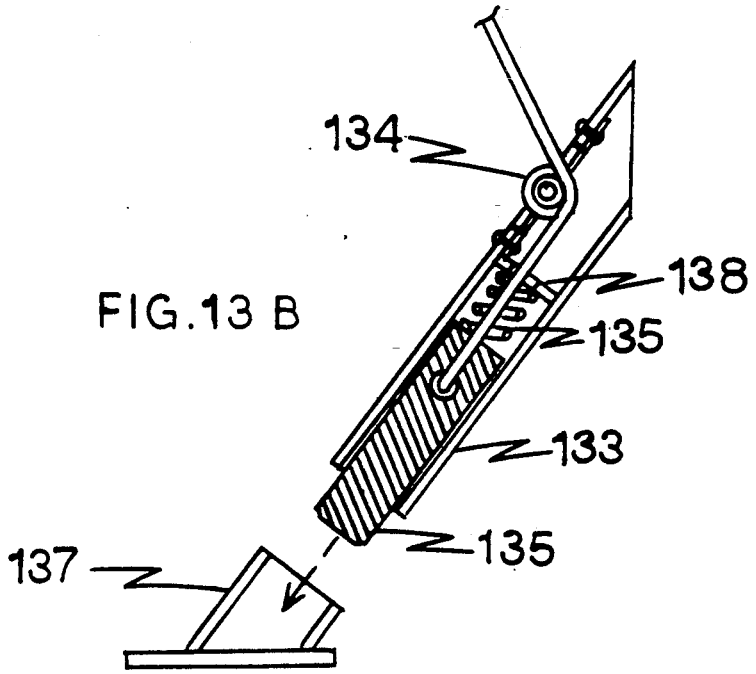
Figure 14A:
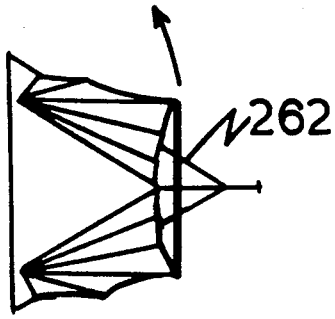
FIGS. 14A, 14B, 14C, 14D and 14E show the transformation sequence used to reverse sail orientation in the sailboat of FIG. 1.
Figure 14D:
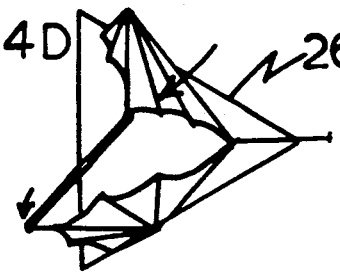
Figure 14B:
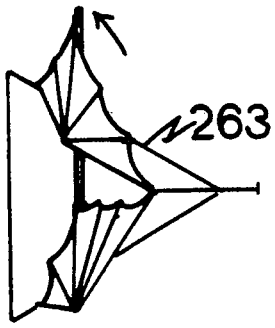
Figure 14E:
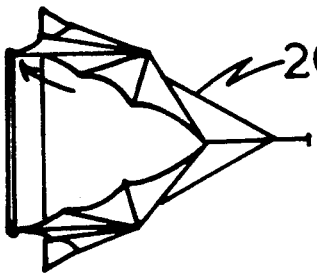
Figure 14C:
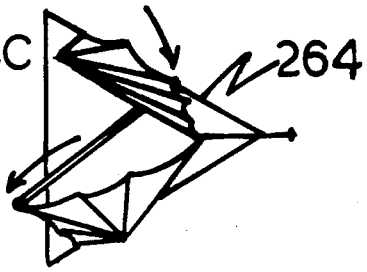
Figures 15A, 15B, 15C, 15D, 15E, 15F, 15G, 15H:
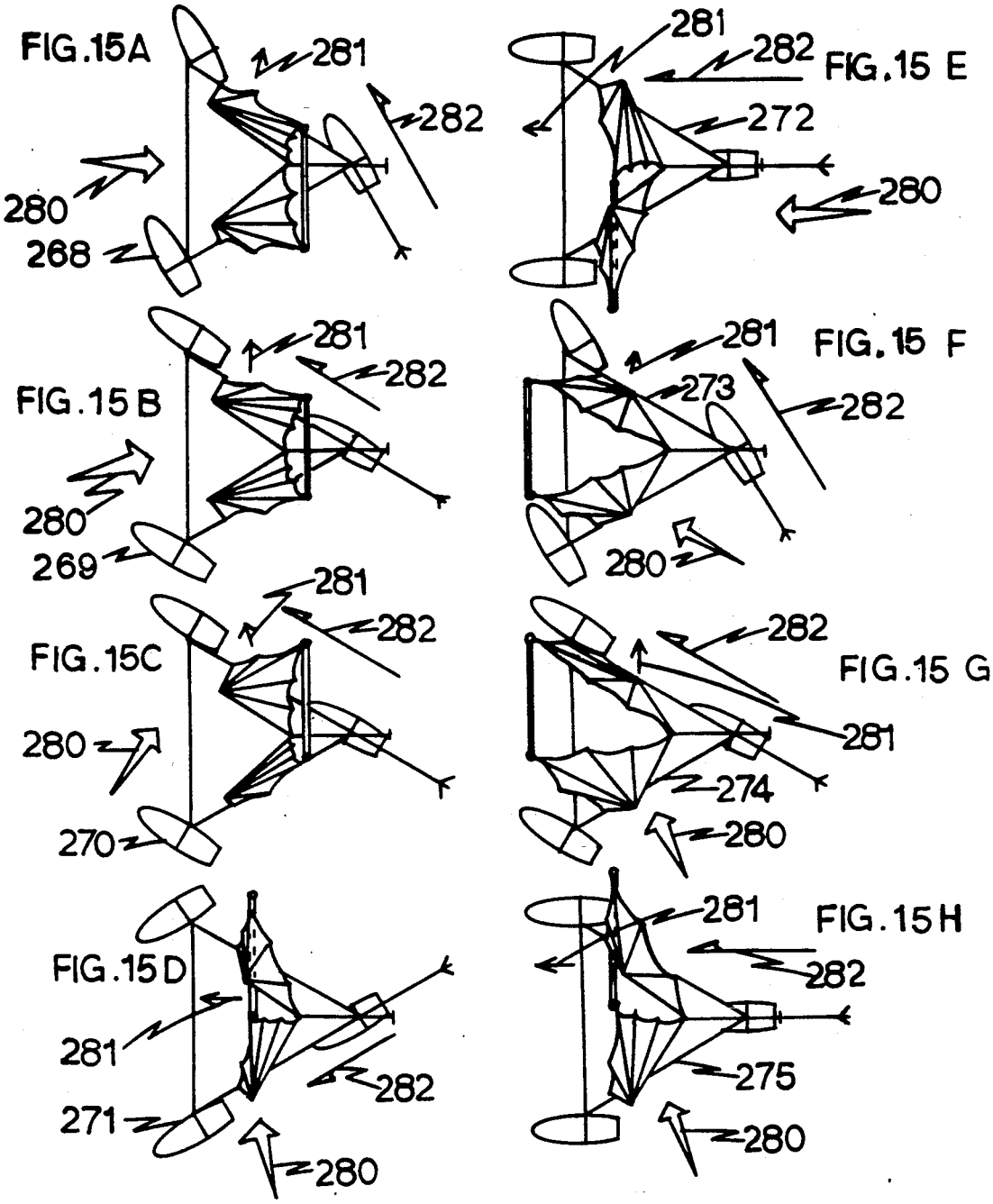
FIGS. 15A, 15B, 15C, 15D, 15E, 15F, 15G and 15H show some of the potential sail and hull orientations possible for the sailboat of FIG. 1.
Figures 16A, 16B, 16C, 16D, 16E:
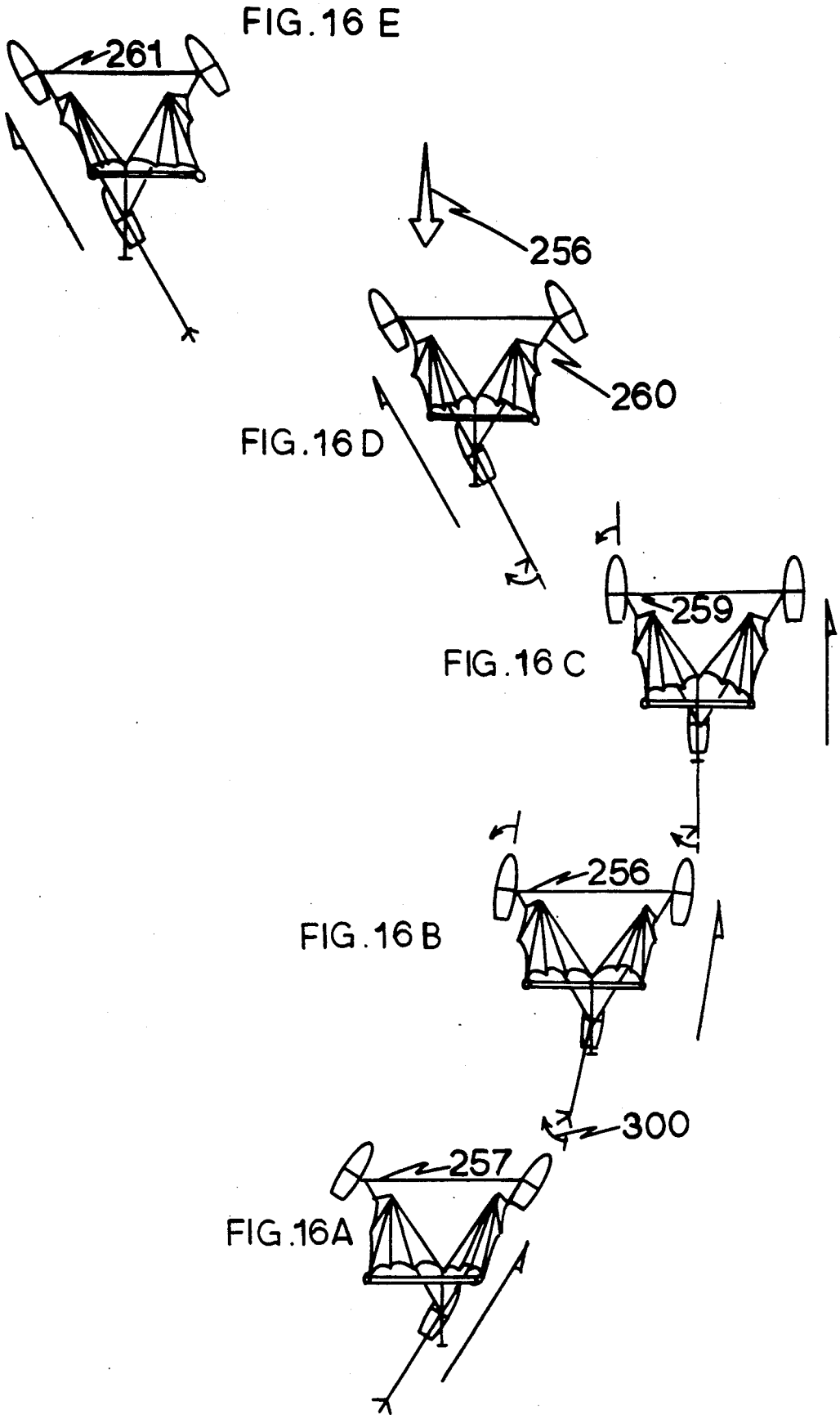
FIGS. 16A, 16B, 16C, 16D and 16E show a typical tacking sequence for the sailboat of FIG. 1.

In actual sailing, the function of the extended rudder structure 197 FIG. 6A and rudder assembly 204 FIG. 6B is illustrated in FIG. 6D wherein the rudder supports itself and the extended rudder structure by its inherent buoyancy thus assuring control in all wave conditions. In addition, it increases the lever arm of the rudder load so as to rotate the hull orientation when the hull lock mechanism 133 FIG. 13B is released by pulling the hull lock release line, 59 FIG. 13A. The tube lock mechanism 247 FIG. 6A is only used when the sailboat in FIG. 1 is on the beach being launched as illustrated in FIG. 19D. FIGS. 7A, 7B and 7C show three of the possible hull orientations relative to the triangular deck frame 1 FIG. 1. Configuration 253 FIG. 7A results when the hull lock mechanism 133 FIG. 13B is locked into socket 257 FIG. 12 Similarly, configuration 254 FIG. 7B corresponds to socket 137 FIG. 12 and configuration 255 FIG. 7C corresponds to socket 256 FIG. 12. The potential orientations of the hulls relative to the triangular deck frame 1 FIG. 1 allow the optimum orientation of the sails relative to the wind and thus the maximum propulsion force on the sailboat as discussed later in more detail.

Figure 8A:
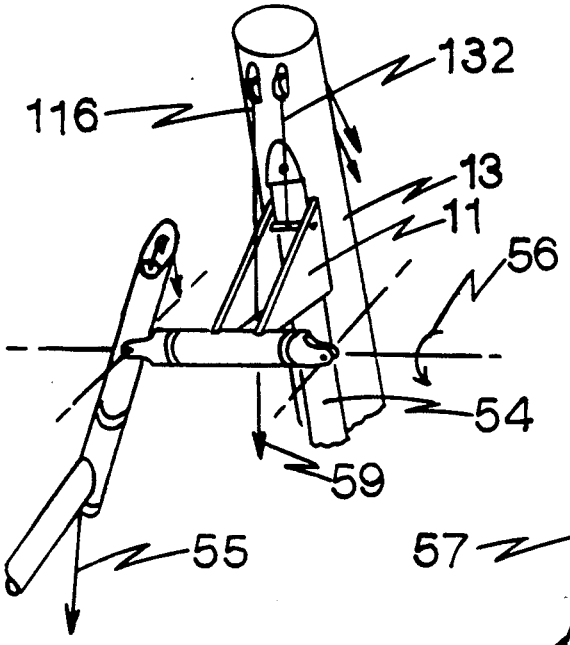
FIGS. 8A, 8B, and 8C show structual details of the dual masts of the sailboat of FIG. 1.

FIG. 8A is an isometric view of the top segment of the mast support strut 13 FIG. 1, illustrating the connection between a typical mast head 3A FIG. 1 and sliding fitting 11 FIG. 1.

Figure 8B:
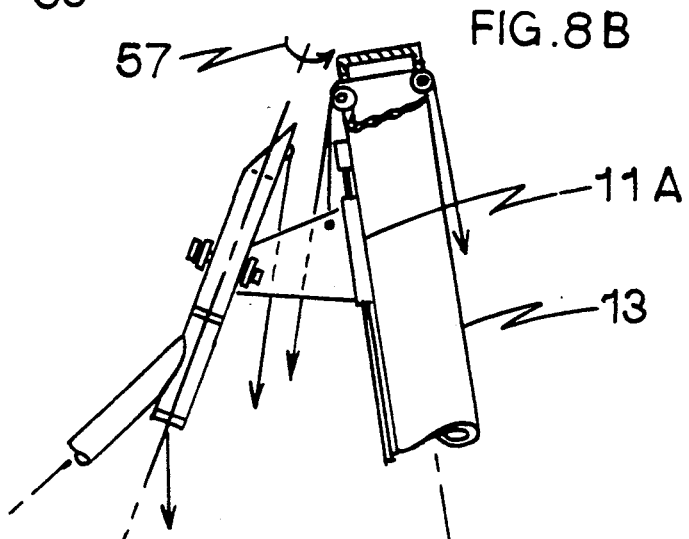
Figure 8B:
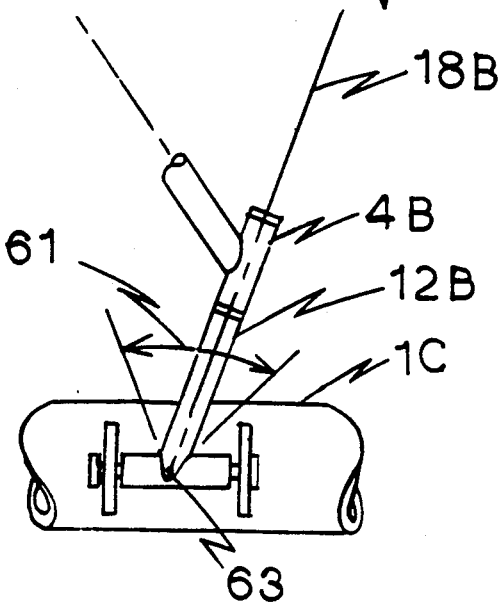

FIG. 8B is a side view of the mast head 4A FIG. 1 and the mast foot 4B FIG. 1 illustrating the axis of rotation for 18B FIG. 6B for mast assembly 4 FIG. 1.

Figure 8C:
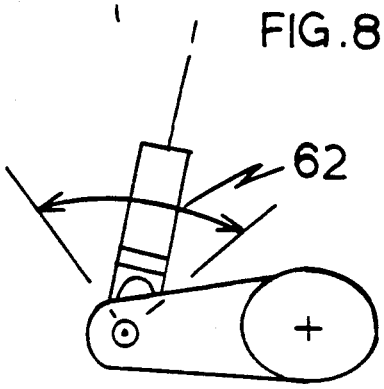

FIG. 8C is an end view of the connection between the port deck beam 1C FIG. 1, and the mast foot 4B FIG. 1.

Figure 17A:
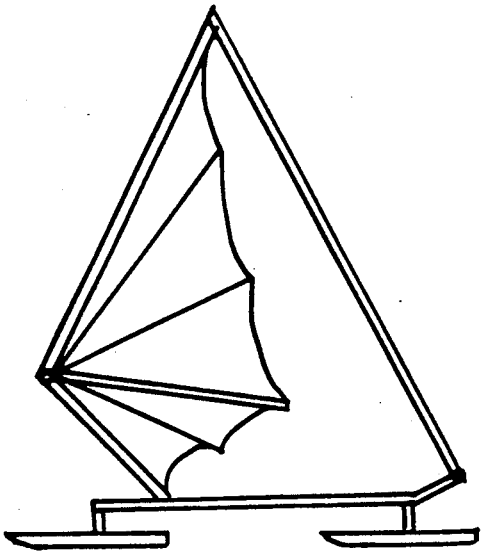
FIGS. 17A, 17B and 17C show the mast folding sequence of the sailboat of FIG. 1.
Figure 17B:
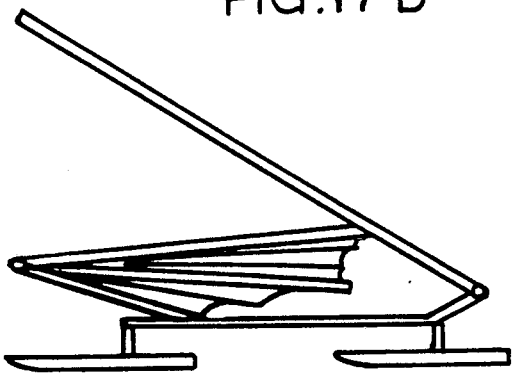
Figure 17C:
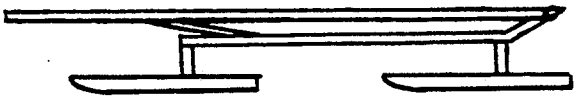

Connection 11 FIG. 8A allows rotation of the mast heads (3A and 4A FIG. 1) to rotate in the direction indicated 56 FIG. 8A as well as in a second direction 57 FIG. 8B. These two degrees of freedom are required to allow the folding sequence to occur without bending loads being imparted to the respective mast assemblies (3 and 4 FIG. 1) or the mast support strut (13 FIG. 1) as shown in FIGS. 17A, 17B and 17C. Cable 55 FIG. 8A is used to control rudder rotation (as illustrated in FIGS. 9A, 9B, 10A, 10B, and 10C), it passes through the center of a pin which is fixed in device 11 (i.e., delrin 1.125 inch in diameter) (not shown). The connection device has a sliding mechanism 11A which rides on a "T" track 54 FIG. 8A affixed to the underside of the mast support strut 13. The track 54 FIG. 8A has a stop at its uppermost point (not shown) to stop the sliding device from moving beyond the end of the track 54 it is pulled by sheet 132 FIG. 8A during deployment (see FIG. 17). Hull lock release line 59 FIG. 8A is used to release the hull lock mechanism 133 FIG. 13B. Both cable 132 and hull lock release line 59 pass through the mast support strut 13 as shown, FIG. 8A. The mast foot 4B FIG. 8B is connected to a mast foot swivel device 12B through a hinge pin (not shown) (i.e., made of delrin, 1.125" OD by 8" long). The swivel device 12B allows rotation (about pin 63 FIG. 8B) along an arc 61 and well as rotation in an arc 62 FIG. 8C. Capture rings (not shown) hold the mast head and foot 4A and 4B onto the respective hinge joints axially but allow rotation about axis 18B FIG. 8B. The sail and the hull orientations are controlled by devices shown in FIG. 9A and 9B. Wishbone booms 9 and 10 have their leech ends affixed to boom cross bar 15. The hull lock release line (59 FIG. 8A), affixed to pad eyes 35 and 70, is pulled downward to release the hull lock mechanism as shown in FIG. 13A and 13B. The exploded view of the leech end of wishbone boom 10 and its coupling to the port side of the boom cross bar 15 is shown in FIG. 9B. It is comprised of the following components typical of both wishbone booms 9 and 10 (except as discussed later). The first component is the hinge pin 71 (i.e., made from 2 inch O.D. delrin stock) which serves as a guide to cable 55 which passes through the central hole 100. This pin 71 also serves as a segment of the connection between the wishbone boom 10 and the boom cross bar 15. After the pin 71 is inserted through the tubular section of the wishbone boom 72 it is fixed into the connecting segment 73 and pinned in place (not shown). Pin 71 allows the wishbone boom to be rotated up to almost 360° in the rotation direction 105 indicated until interference between the boom cross bar 15 and the lower mast segment 22 FIG. 3B stops the motion. The horizontal hinge pin 78 FIG. 9B fits into segment 73 FIG. 9B such that the slot 99 lines up with the central hole 100 in hinge joint 71. Hinge pin 78 is locked axially into segment 73 but still can rotate up to 180° as indicated 77. Cable 55 passes through slot 99 and through the central hole and exits the hinge pin 78 in the enlarged cavity 98. The connecting segment 80 fits over hinge pin 78 and is locked onto it. The segment 80 can rotate up to 180° in the indicated directions 107 before the cable 55 contacts the ends of the slot 99. The boom cross bar is fixed to the winch section 96 FIG. 9B. This in turn is fixed to the shaft 94 which has a 45° bevel gear 95 affixed to it. The winch section 96 fits inside segment 80 so that the opening 98 in hinge pin 78 lines up with the width of the winch section 96 once in its final assembled position. This final axial position is located by the enlarged diameter of the boom cross bar 15 (whose O.D. corresponds to the O.D. of segment 80) coming in contact with segment 80. The end fitting 81 fits over shaft 94 and maintains it in the center of the mating component 80, lock ring 82 slips over shaft 94 and locks the ring and the shaft in is assembled axial location. The assembly 111 (which is comprised of shaft 90, fixed to universal joint 91 which in turn is fixed to shaft 92 which in turn is fixed to ring 93) is inserted through the bearing 87 and which is fixed to the 45° bevel gear 86. The assembly 111 is inserted through tube 84 affixed to segment 80. The tube 84 axis makes a 45° angle with the vertical direction to allow maximum rotation ability of the universal joint 91. The assembly 111 fits into the segment 80 as indicated until the bevel gear 86 mates with the bevel gear 95 at which point assembly 111 is locked into tube 84 in the segment 80. Returning to the cable 55 it exits the opening 98 and is wrapped around the winch drum 96 and is fixed to drum 96. The corresponding connection between wishbone boom 9 and boom cross bar 15 is the mirror image of the components in FIG. 9B except that the hinge pin 78 has the opening 98 in the bottom half of the pin corresponding to hinge pin 78 (not shown). This is required so that rotation of the boom cross bar 15 FIG. 9A allows wind up of cable 55 and let out of cable 68 when rotated in direction 106 FIG. 9B and the reverse when rotated in the direction counter to 106 FIG. 9B (as illustrated in 114 FIG. 10A). The rotation of the boom cross bar 15 in direction 114 FIG. 10A (about its cylindrical axis 310 FIG. 9B) causes the unwinding of the port winch drum 96 FIG. 9B and hence the indicated motion 115 in cable 55 FIG. 10A. This cable passes up through the hinge pin 58 FIG. 10A in the mast head 4A FIG. 8A over pulley 116 FIG. 8A then down along the mast support strut 13 through a pulley 117 at the base of mast support strut 13 (FIG. 10A). From there cable 55 goes into pulley 118 at the top of the stern vertex assembly 2C then down through a hinge pin (not shown) inside vertex 2C FIG. 10C then out through pulley 279 and from there out through fairlead 121 FIG. 10A. Finally cable 55 is affixed to the rudder port bell crank arm 122 which rotates in direction 123 as the starboard bell crank arm 124 is pulled by tension in cable 68 affixed to it. FIG. 10C shows a detailed drawing of the stern vertex assembly 2C; it is primarily comprised of three major components, the first of which is the hinge pin housing 127, the second of which is part of the stern vertex assembly 2C, FIG. 4D. The hinge pin (not shown) is fixed to the lower segment 128 (the third major component) and the upper segment 127 but allowed to rotate freely within segment 119

(this pin can be fabricated from 2 inch O.D. Delrin rod). The path of cables 55, 68 shown schematically in FIG. 10A are shown in more detail with respect to the mast support strut 13 in FIG. 11. The hull lock release line, cable 59 passes down the backside of the mast support strut 13 into the hull lock mechanism 133 affixed to the mast strut 13, and shown in detail in FIG. 13B. A schematic drawing of hull lock release line 59 path is shown in FIG. 13A. It is connected to eye pads 35 and 70 at the leech end of wishbone booms 10, 9 respectively. From there it goes up over a pulley in the top of the mast support strut 13 and down to the hull lock mechanism 133 pulley 134 FIG. 13B. The hull lock release line 59 then passes through compression spring 135 into the locking pin 136 to which it is affixed. A small plate 138 pinned into the assembly 133 resists the spring 133 compression when hull lock release line 59 is pulled to remove pin from a typical socket 137 of the hull lock bell crank (141 FIG. 12). Upon release of the tension in the hull lock release line 59 FIG. 13B by the helmsman, spring 133 pushes the locking pin 136 into a socket such as 137 locking the hulls orientation (as illustrated in FIG. 7A).

Figure 11:
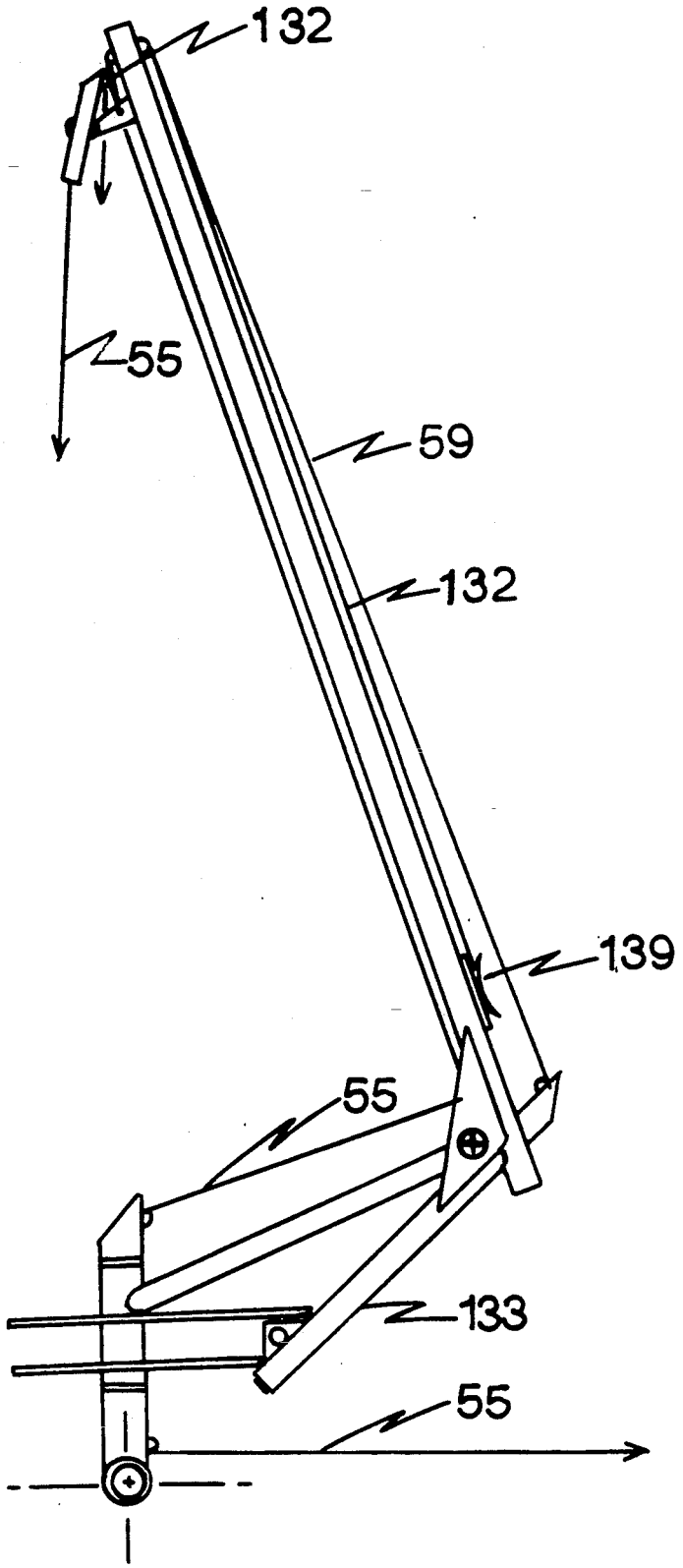
FIG. 11 shows structual details of the mast support strut of the sailboat of FIG. 1.

Turning now to mast assembly deployment and starting from a complete folded configuration FIG. 17C, the following mast assembly elevation sequence is utilized. In this discussion only the use of the mast support strut in FIG. 1 is discussed. The folding of the mast assembly knuckle joint hinges is addressed later. The first step requires that the mast support strut be elevated and locked by pin 140 FIG. 12 into it which is the final deployment orientation relative to triangular deck frame 1 FIG. 1. Then the slide mechanism 11A which carries the mast heads 3A, 4A moves up along track 54 FIG. 8A. Cable 132 is attached to this sliding mechanism and passes through the pulleys in the head of the mast support strut 13 as shown in FIG. 8A and 11. The helmsman pulls on cable 132 until the sliding mechanisms 11A pulls the mast assemblies 3, 4 into their deployed positions FIG. 1. Cable 132 is then fixed about cleat 139 FIG. 11.

The twin sail and boom cross bar configuration as shown in FIG. 1 has the additional ability to reverse the leading edges of the mast/sail assemblies so that they might face the stern of the sailboat (as opposed to facing the bow of the sailboat as shown in FIG. 1). The need for the sail reverse maneuver is explained later. The sail reverse sequence is shown in FIGS. 14A through 14E. Starting at configuration 262 FIG. 14A, the helmsman shifts the boom cross bar (15 FIG. 9A) to the starboard side of the triangular deck frame 1, FIG. 1. The wishbone booms (9, 10 FIG. 9A) almost line up as both sails (7 and 8 FIG. 1) almost fall into the same plane. At this point the helmsman pushes the port side of the boom cross bar (15 FIG. 9A) through toward the bow deck beam (1A FIG. 1) as shown in configuration 263 FIG. 14B. The mast assemblies are now acting like the divots of a lifeboat, where the lifeboat corresponds to the boom cross bar, the leech end of wishbone boom 10 FIG. 1 is now forward of the far deck beam 1A FIG. 1 as shown in configuration 264 FIG. 14C. The helmsman now pushes the boom cross bar connected to the leech end of the wishbone boom 9 FIG. 1 up to the bow deck beam 1A FIG. 1 as shown in configuration 265 FIG. 14D. The helmsman continues to push the boom cross bar 15 FIG. 9A forward until it all is forward of and parallel to the bow deck beam 1A FIG. 1, at which point the sails have been reversed configuration 266 FIG. 14E. The boom cross bar is still within the reach of the helmsman in this configuration 266 FIG. 14E but he may elect to use the ring 93 FIG. 9B to maintain control without stretching for the boom cross bar. The ring 93 FIG. 9B can be used to push or pull the boom cross bar (15 FIG. 1) because it is attached to two rods 90, 92 FIG. 9B connected to the boom cross bar 15 FIG. 9A. Furthermore, if the ring is rotated about the axis in direction 267 FIG. 9B it will rotate the boom cross bar by means of bevel gears 86, 95 FIG. 9B and hence the rudder as explained earlier. These rings 93 FIG. 9B (typical) can also be used to control the sails and rudder orientations if the helmsman elects to sit on the webbing 16 FIG. 1.

FIGS. 15A through 15H illustrate some possible hull and sail configurations with the leading edge of the sails primarily pointing toward the bow, configurations shown in FIGS. 15A, 15B, 15C, 15D, as well as with the leading edge of the sails primarily pointing toward the stern, configurations FIG. 15E, 15F, 15G, 15H. In each configuration the wind is indicated by the large arrow 280 and the lift force of the sails on the sailboat indicated by the small arrow 281. The sailboat's sailing direction is indicated by the direction the hulls are pointed in arrow 282 (in FIGS. 15A, 15B, 15C, 15D, 15E, 15F, 15G, 15H) thus even in sailing downwind the sails can be reversed so as to achieve the maximum lift and minimum drag forces.

A tacking maneuver is shown in FIGS. 16A through 16E. The wind direction is indicated by arrow 256 in FIG. 16E. In the initial sailing configuration 257 FIG. 16A the sailboat is on a port reach. The helmsman pulls the hull lock release line 59 FIG. 13A to release the hull lock mechanism with one hand. He simultaneously pushes the boom cross bar 15 FIG. 9A to the right and rotates it at the same time to rotate the rudder. The rotated rudder generates a side thrust on the rudder support structure. This in turn puts a large torque on the stern hull which is transmitted simultaneously to the starboard and port hulls via the bell crank and the associated tubes explained earlier. The net result is that the hulls begin to rotate as shown in configuration 258 FIG. 16B. Now he continues shifting the boom cross bar 15 FIG. 9A to the right bringing the sails into "irons". The rudder is still rotated and the hulls still unlocked so the hulls have now shifted as indicated in 259 FIG. 16C. The helmsman continues to move the boom cross bar to the right and the sails start to generate lift on the port side, the hull lock pin has passed over socket 137 FIG. 12 and the hulls are almost in final position for the starboard tack as shown in configuration 260 FIG. 16D. Finally the helmsman releases the hull lock release line 59 and the hulls are locked in the starboard tack orientation. The helmsman rotates the boom cross bar 15 FIG. 9A back to the nominal position (rudder lined up with stern hull) and shifts the sails to the appropriate location by moving the boom cross arm to the right as shown in configuration 261 FIG. 16E.

The initial configuration at the start of the folding sequence of the sailboat is shown in FIG. 17A, wherein the sails and masts are fully deployed. Release of cable 132 from cleat 139 in FIG. 11 will allow the slider mechanism 11A and the attached mast head connection 11 in FIGS. 8B to move down along the track 54 FIG. 8A, a short distance. Then the mast assembly knuckle joint hinges are unlocked, FIGS. 2F and 2G respectively. Cable 132 FIG. 11 is released further until configuration in FIG. 17C is achieved. Locking pin 140

FIG. 4D is released and the mast strut 13 lays down as shown in FIG. 17C. FIG. 18A shows a schematic isometric view of the sailboat in FIG. 17C. The hinge 246 FIG. 1 of the bow deck beam 1A is unlocked and the tube 165 FIG. 1 is removed as is the boom cross bar 15 FIG. 9A and the extended rudder structure and rudder, 197, 204 FIG. 6A respectively. The bow deck beam 1A is now folded in toward the stern, causing the folding of the starboard and port deck beams 1B, 1C respectively FIG. 1 together in a scissor-like action and also folding the webbing 16 FIG. 1. This configuration, partially folded, is shown in FIG. 18B. The final folded configuration is shown in FIG. 18C.

Figure 19A:
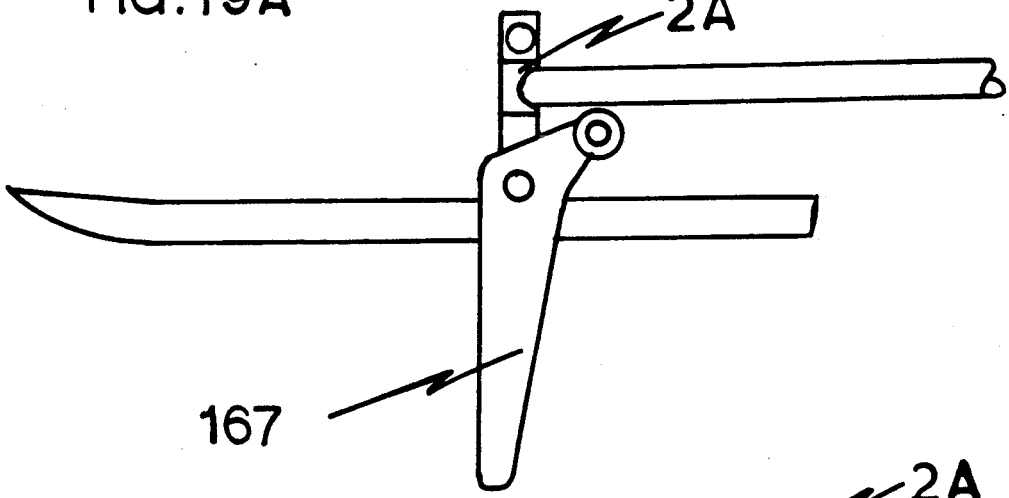
FIGS. 19A, 19B and 19C show the deployed daggerboard, the front view of the vertex assembly, and the daggerboard orientation used on land, respectively in the sailboat in FIG. 1.
Figure 19B:
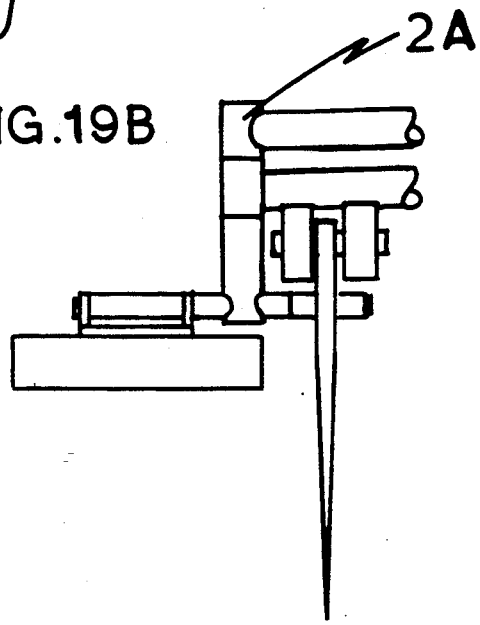
Figure 19C:
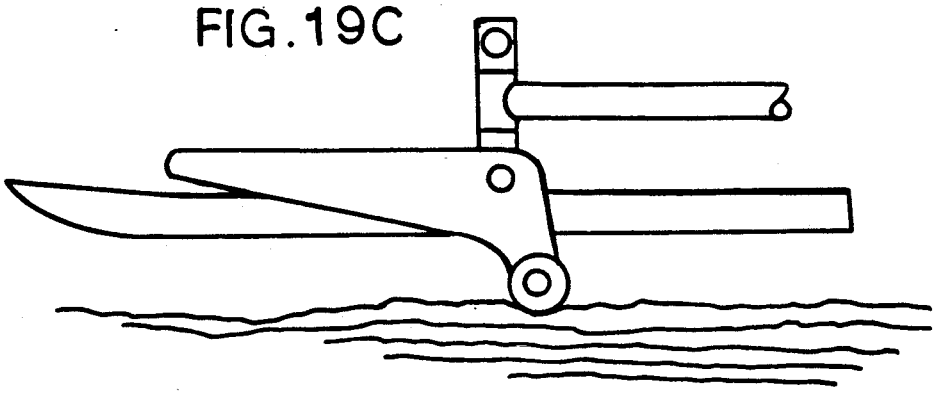
Figure 19D:
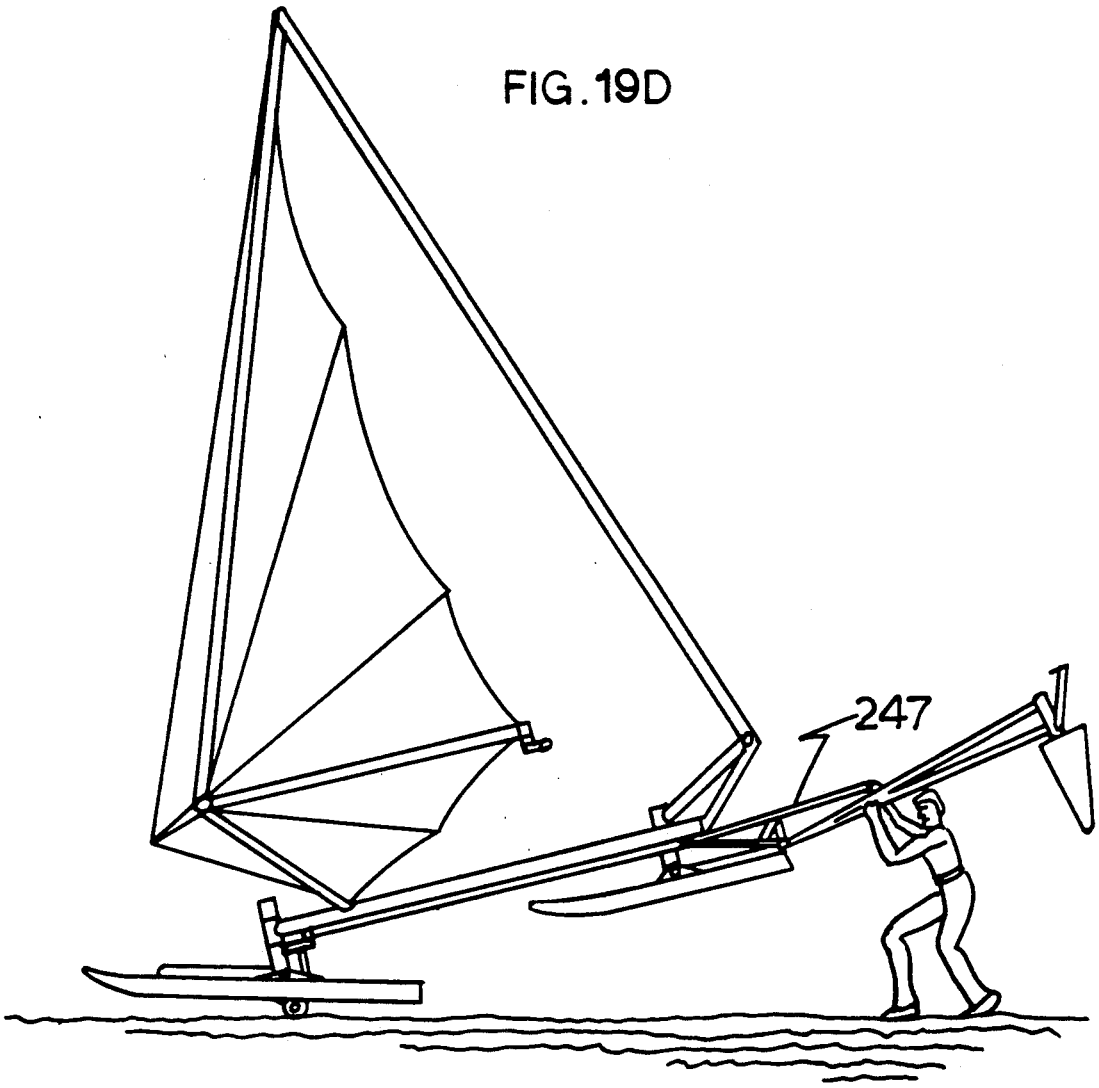
FIG. 19D illustrates the use of the extended rudder support to provide leverage in lifting the sailboat stern. The rollers on the two bow centerboards provide the ability to roll the sailboat of FIG. 1 into and out of the water on the beach or launch area.

FIGS. 19A, B, C and D illustrate the possible orientations of the daggerboard wheels (166 FIG. 3A). FIG. 19A shows the daggerboard 167 down orientation. FIG. 19B shows a front view of the starboard bow vertex (2A FIG. 1). FIG. 19C shows the daggerboard 167 locked in the wheels down orientation by means of the locking pin (not shown) for moving the sailboat on the beach without scraping the bow hulls. FIG. 19D shows the use of a tube locking mechanism 247 which fits between tube 201 FIG. 6A and bell crank 141 FIG. 6A. This tube allows the stern of the hull of the sailboat to be lifted off the sand by means of the helmsman lifting the now rigidized but previously moveable extended rudder structure.

Figure 20A:
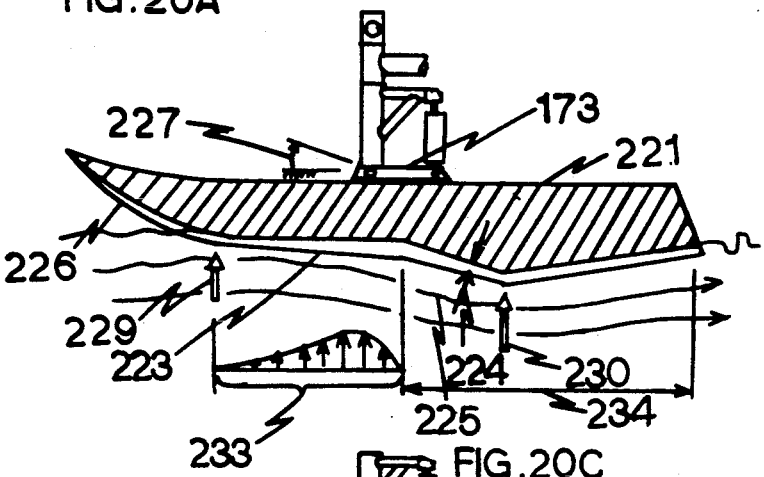
FIGS. 20A, 20B, 20C and 20D show the respective orientations of a typical hull under displacement and planing modes of motion for the sailboat of FIG. 1.
Figure 20B:
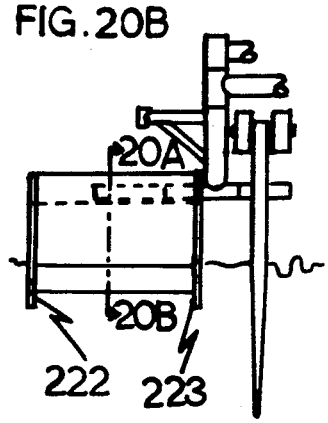

Now turning to the hull design, FIGS. 20A, B, C and D show the details of the design. The side view of a starboard hull 6A FIG. 1 (typical) is shown in FIG. 20A, port hull 6B would only differ by having a mirror image hull bearing block (174 FIG. 3A) configuration. The stern hull 6C in FIG. 1 would differ both in that the hull bearing block 145 FIG. 6A would be in the place of hull bearing block 173 FIG. 20A shown, and in that the stern hull shock absorber housing 180 FIG. 6A would be in location 221 FIG. 20A. Each hull is approximately rectangular in the top view (not shown) as well as in the front view FIG. 20B. This will be explained shortly. The side sectional view of a typical hull FIG. 20A shows that the side plates 222, 223 FIG. 20A extending down a small distance on either side below the main middle section of the hull 225 FIG. 20B. The side plates 222, 223 FIG. 20B channel the flow of water passing beneath the bow so that it travels straight backwards under the hull 225 FIG. 20A. The plates 222, 223 FIG. 20B are parallel to insure that the sides of the hull don't exert any force to push the water sideways as in the case of a standard "V" hull cross section, thus eliminating a component of drag. Furthermore the momentum change in the water passing under the hull just acts to lift the hull out of the water. The side plates also force a mixture of air and water foam which enters at the lower bow surface 226 FIG. 20A to remain under the hull until it exits at the stern of the hull. This lowers friction between the hull and the water.

Figure 20C:
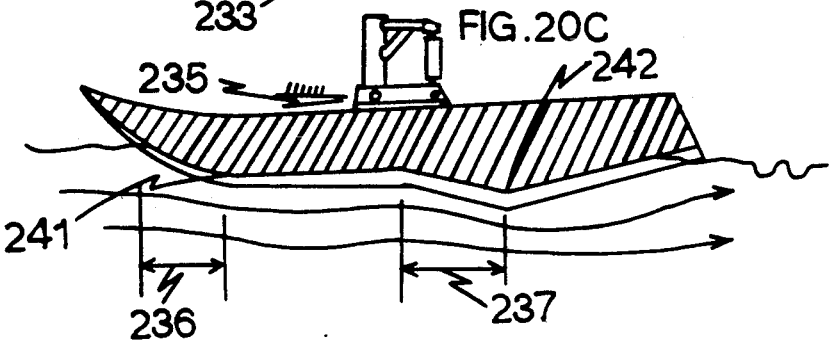
Figure 20D:
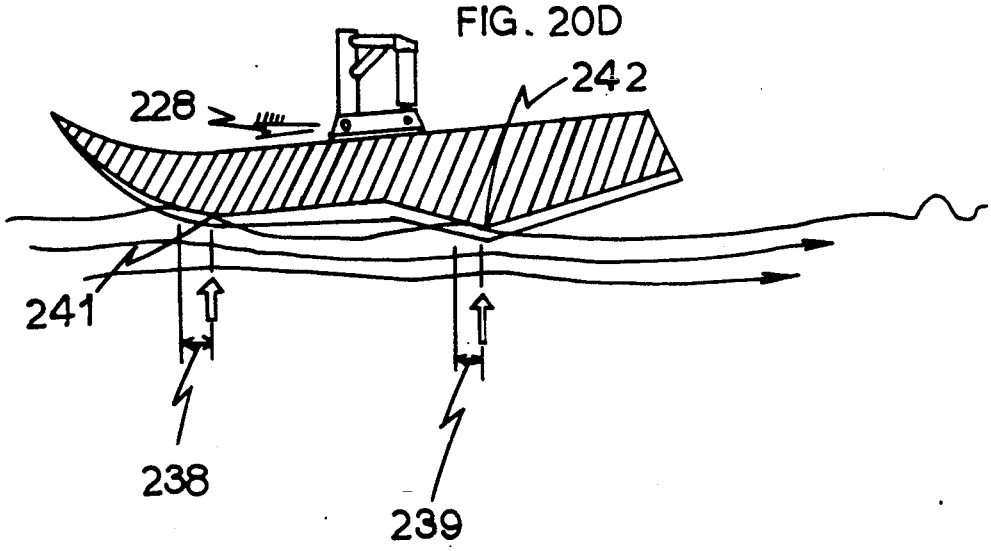

FIG. 20A shows the maximum angle 227 that each hull can make relative to the triangular deck frame 1 FIG. 1, as constrained by the maximum extended length of the shock absorber as shown 172 FIG. 3A explained earlier. FIG. 20D shows minimum angle 228 that the hull can make with the triangular deck frame 1, FIG. 1, as constrained by the minimum compressed length of the shock absorber 172 FIG. 3A explained earlier. FIGS. 20A, C and D all show section AA of the hull 6C to aid in visualization of the water flow under the hull. The principles behind the hull design are as follows: when the hull 6C FIG. 20A is moving through the water below its planing speed, the hull is maintained in an approximately horizontal orientation (i.e., the deck of the hull is assumed parallel to the water surface) by a balance between the resultant buoyancy forces, a small force 229 at the bow with a large lever arm relative to the center line 305 FIG. 20A of the hull bearing block 173, and a large force 230 with a small lever arm relative to the center line of the hull bearing block. As the flow moves under the bow in the region 233 it generates a pressure distribution under the hull in this region which would normally hold up the bow wave caused by the "belly" of the hull in section 234, but the wave does not exist, just the equivalent pressure on the hull in section 233. Therefore the drag associated with the bow wave is eliminated and replaced by a much lower friction drag along the horizontal section 233. This is further reduced by the fact that a compressed air/water foam layer is in direct contact with the hull and not only liquid water as discussed earlier. As the speed of the hull through the water increases, the bow of the hull starts dropping slightly 235 FIG. 20C, and momentum change induced lift in sections 236 and 237 starts replacing buoyancy lift causing hull 6C to generally raise higher in the water. When the speed of the hull has increased sufficiently, the bow of the hull drops further (angle 228) FIG. 20D and the hull is planing on two short sections of hull 238, 239; this is considered the optimum planing orientation. This planing is facilitated by the sharp break in the hull profile at points 241, 242 FIG. 20C which encourages separation of the flow at these points. The bow of the hull can dip no further due to the constraint of the shock absorber 172 FIG. 3A being fully compressed. This prevents the hull from digging in and causing pitch poling. The operation of this hull configuration to eliminate bow wave drag and to encourage controlled planing is enhanced by the maintenance of the hull bearing pin 173 FIG. 3A (typical) in a plane parallel to the triangular deck frame 1 FIG. 1 and hence the undisturbed water surface. The two point support of the hull (i.e., forces at) 241, 242 FIG. 20D on either side of the hull bearing plate 173 FIG. 20A keeps the hull in dynamic equilibrium even under high speed sailing conditions.

Both the daggerboards 167 FIG. 3A (typical) and the rudder 204 FIG. 6A are foils which pierce the surface of the water. When the water impinges on the leading edge of such a foil some of it is deflected upward along the leading edge causing the generation of undesirable spray and considerable drag force.

Figure 21A:
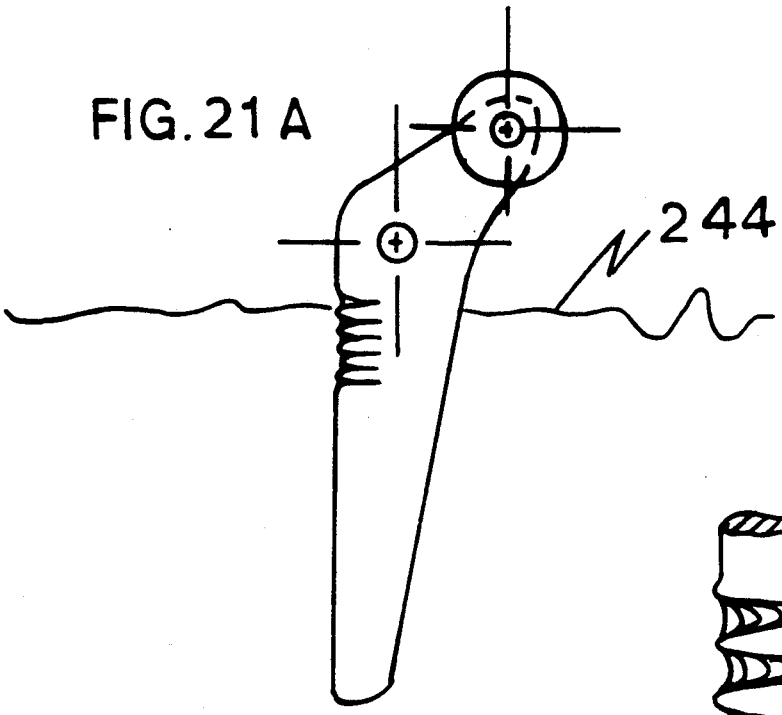
FIGS. 21A, 21B, 21C, 21D and 21E illustrate the splash suppression profiles and the cross-section of the leading edge of the leading edge of the bow daggerboards of the sailboat in FIG. 1.
Figure 21B:
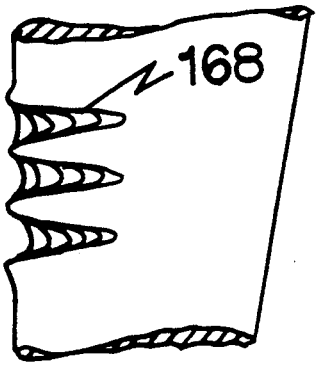
Figure 21C:
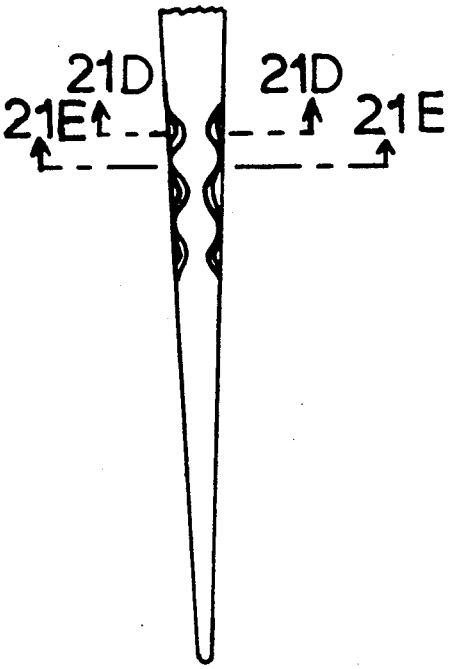
Figure 21D:
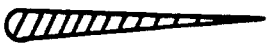
Figure 21E:
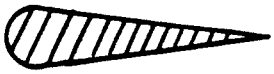

The typical daggerboard 167 and the rudder (not shown) all incorporate the leading edge configuration of the foil shown in FIG. 21A, 21B and 21C wherein grooves 168 FIG. 3A are fabricated into the foil in the region where the foil pierces the water surface 244. The grooves give the leading edge a serrated geometry similar to a knife edge. These serrations or grooves in the direction of ideal flow across the foil, make flow up along the leading edge of the foil less energetically favorable than flow along the grooves. Thus this configuration reduces induced spray and the associated drag caused by the energy required to cause the surface water to make a 90° turn on impact with the leading edge of the foil.

What is claimed is:

1. A sailboat adapted to sail on water in a sailing direction that comprises in combination: a triangular deck frame, said triangular deck frame having a bow deck beam, a starboard deck beam, and a port deck beam, said bow deck beam having one hinge at the center thereof, said triangular deck frame further having at least three vertex assemblies, one vertex assembly being located at each vertex of said triangular deck frame, wherein a stern vertex assembly connects said starboard deck beam and said port deck beam, a starboard bow vertex assembly connects said bow deck beam and said starboard deck beam, and a port bow vertex assembly connects said bow deck beam and said port deck beam;

a starboard hull, a port hull, and a stern hull, said starboard hull being connected to said starboard bow vertex assembly, said port hull being connected to said port bow vertex assembly, and said stern hull being connected to said stern vertex assembly respectively, said starboard, port, and stern hulls supporting said triangular deck frame;

webbing stretched between said bow, port and starboard deck beams, said webbing forming a support for a helmsman;

a first and a second foldable mast assembly, a first and a second knuckle joint hinge, said first foldable mast assembly being foldable about said first knuckle joint hinge, said second foldable mast assembly being foldable about said second knuckle joint hinge;

a first and second locking device, said first locking device locking said first knuckle joint hinge, said second locking device locking said second knuckle joint hinge so as to make rigid said first and said second foldable mast assemblies;

a mast support strut, said mast support strut having means to unfold said first and said second foldable mast assemblies when said first and said second foldable mast assemblies are folded, and said mast support strut supporting said first and said second foldable mast assemblies in a substantially upright position when said first and said second locking devices lock said first and said second knuckle joint hinges and make rigid said first and said second foldable mast assemblies;

a boom cross bar, said boom cross bar having a longitudinal axis, a pot end and a starboard end, a first wishbone boom, a second wishbone boom, said first wishbone boom having a first end and a leech end, said second wishbone boom having a first end and a leech end, said first end of said first wishbone boom being connected to said first foldable mast assembly, said first end of said second wishbone boom being connected to said second foldable mast assembly, said port end being connected to one of said first and second leech ends of said first and said second wishbone booms, said starboard end being connected to the other of said first and said second leech ends of said first and said second wishbone booms;

a rudder, said rudder being supported by said stern vertex assembly;

a first sail supported by said first foldable mast assembly, and a second sail supported by said second foldable mast assembly;

and wherein lateral movement of said boom cross bar changes the orientation of said first and said second sails, and rotation of said boom cross bar about its said longitudinal axis controls said rudder so as to steer said sailboat.

2. A sailboat adapted to sail on water in a direction as claimed in claim 1 wherein said sailboat has a first and second daggerboard, said first daggerboard connected to said port bow vertex assembly, and said second daggerboard connected to said starboard bow vertex assembly;

wherein said first and said second daggerboard can be inserted or retracted.

3. A sailboat adapted to sail on water in a direction as claimed in claim 1 wherein said sailboat has a first, second and third shock absorber, said first shock absorber being connected between said port bow vertex assembly and said port hull, said second shock absorber being connected between said starboard bow vertex assembly and said starboard hull, and said third shock absorber being connected between said stern vertex assembly and said stern hull;

wherein said first, said second, and said third shock absorber limits sailing related vibration frequency and magnitude of said port, said bow, and said stern hull respectively.

4. A sailboat adapted to sail on water in a direction as claimed in claim 1 wherein said sailboat has an extended rudder structure having a first end and a second end, said first end connected to said stern vertex assembly, and said second end connected to said rudder;

a hull lock mechanism fixed to said mast support strut and connectable to said stern vertex assembly;

wherein said extended rudder structure increases the turning torque on said sailboat generated by said rudder in steering, and increases the turning torque generated by said rudder, in rotation of said port hull, said starboard hull, and said stern hull relative to said triangular deck frame, when said hull lock mechanism is disconnected from said stern vertex assembly.

5. A sailboat adapted to sail on water in a direction as claimed in claim 1 wherein said sailboat has a means for raising and lowering said mast support strut; and a means for folding said triangular deck frame.

6. A sailboat adapted to sail on water in a direction as claimed in claim 1 wherein said sailboat has a configuration of said port hull, said starboard hull, and said stern hull;

wherein said configuration provides both displacement and planing mode flow resistance reduction.

* * * * *